US009361792B2

(12) United States Patent
Roper et al.

(10) Patent No.: US 9,361,792 B2
(45) Date of Patent: Jun. 7, 2016

(54) SELF POSITIONING FLOATING PLATFORM AND METHOD OF USE

(71) Applicant: Ensco International Incorporated, Wilmington, DE (US)

(72) Inventors: Richard Robert Roper, Katy, TX (US); Christopher Scott Stewart, Cornelius, NC (US); Justin Dow Alcorn, Houston, TX (US); Steven Andrew Leppard, West University Place, TX (US)

(73) Assignee: Ensco International Incorporated, Wilmington, DE (US)

( * ) Notice: Subject to any disclaimer, the term of this patent is extended or adjusted under 35 U.S.C. 154(b) by 0 days.

(21) Appl. No.: 14/663,698

(22) Filed: Mar. 20, 2015

(65) Prior Publication Data

US 2015/0266544 A1 Sep. 24, 2015

Related U.S. Application Data

(60) Provisional application No. 61/968,515, filed on Mar. 21, 2014.

(51) Int. Cl.

| | |
|---|---|
| ***B63B 19/18*** | (2006.01) |
| ***G08C 19/16*** | (2006.01) |
| ***B63B 35/44*** | (2006.01) |
| *B63B 3/14* | (2006.01) |

(52) U.S. Cl.
CPC ..... *G08C 19/16* (2013.01); *B63B 35/4413* (2013.01); *B63B 2003/147* (2013.01)

(58) Field of Classification Search
CPC ..... B63B 3/54; B63B 19/18; B63B 2003/147
USPC ..... 166/355; 405/203, 223.1, 224, 224.2, 405/224.4
See application file for complete search history.

(56) References Cited

U.S. PATENT DOCUMENTS

| | | | | |
|---|---|---|---|---|
| 4,557,332 | A * | 12/1985 | Denison et al. | 166/345 |
| 8,316,929 | B2 * | 11/2012 | Angelle et al. | 166/77.1 |
| 8,875,793 | B2 * | 11/2014 | Christensen et al. | 166/345 |
| 2004/0089215 | A1 * | 5/2004 | Roodenburg et al. | 114/201 R |

* cited by examiner

*Primary Examiner* — Sunil Singh
(74) *Attorney, Agent, or Firm* — Fletcher Yoder, P.C.

(57) ABSTRACT

Techniques and methods to reduce downtime in an offshore platform, such as an offshore semi-submersible drilling rig or drillship. Through the use of one or more movable platforms in a moon pool area, work on a riser string passing through the moon pool area may be performed without exposing workers directly to the open sea below. Accordingly, the use of the one or more movable platforms in the moon pool area may provide protected access to the riser string during, for example, harsh weather conditions.

19 Claims, 20 Drawing Sheets

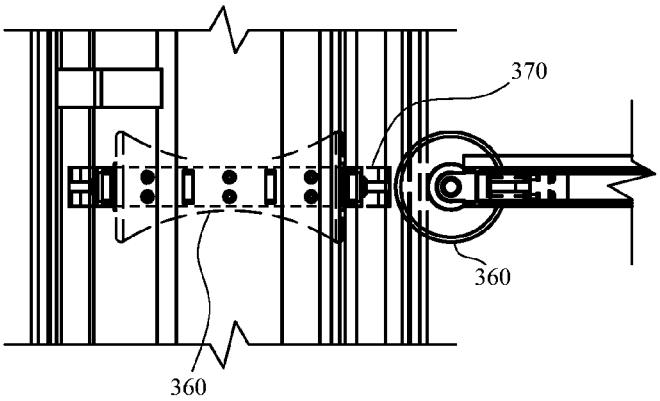
FIG. 7C
FIG. 8A
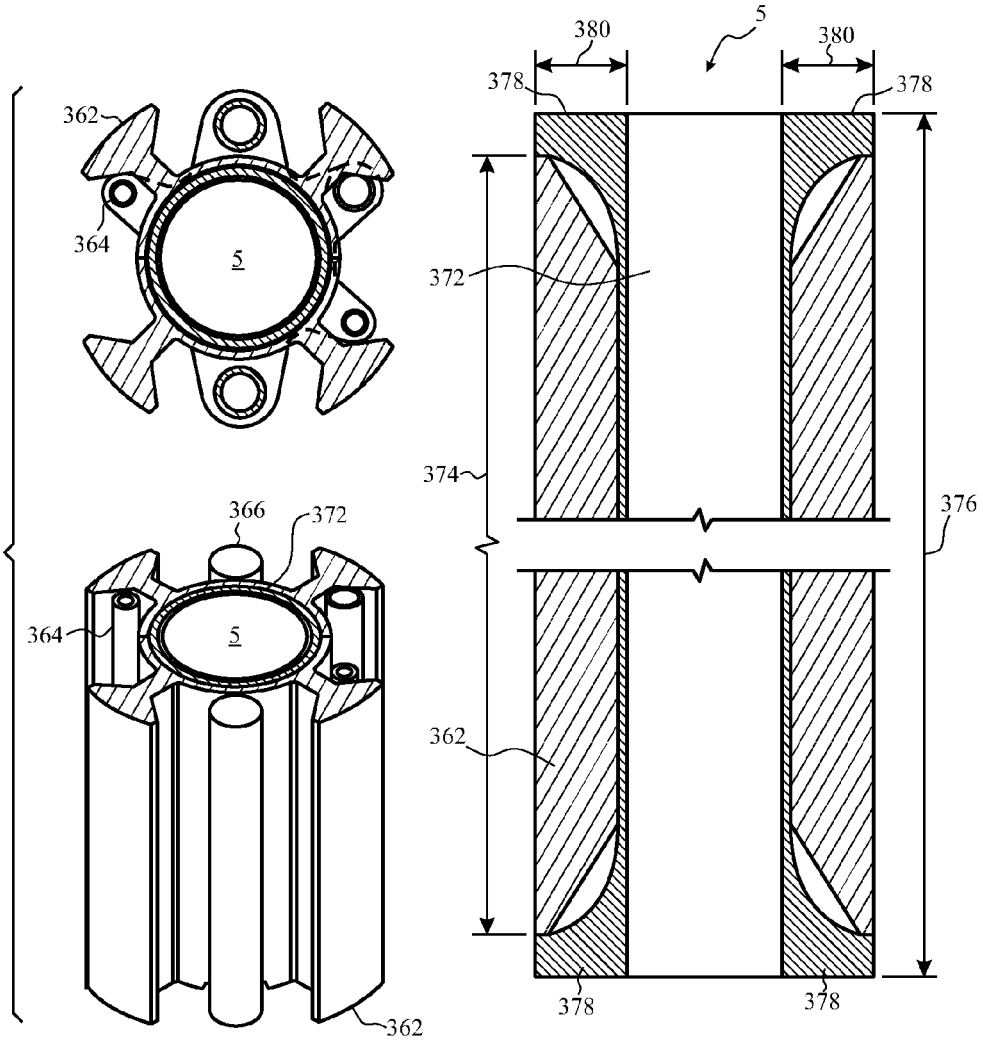

FIG. 8B
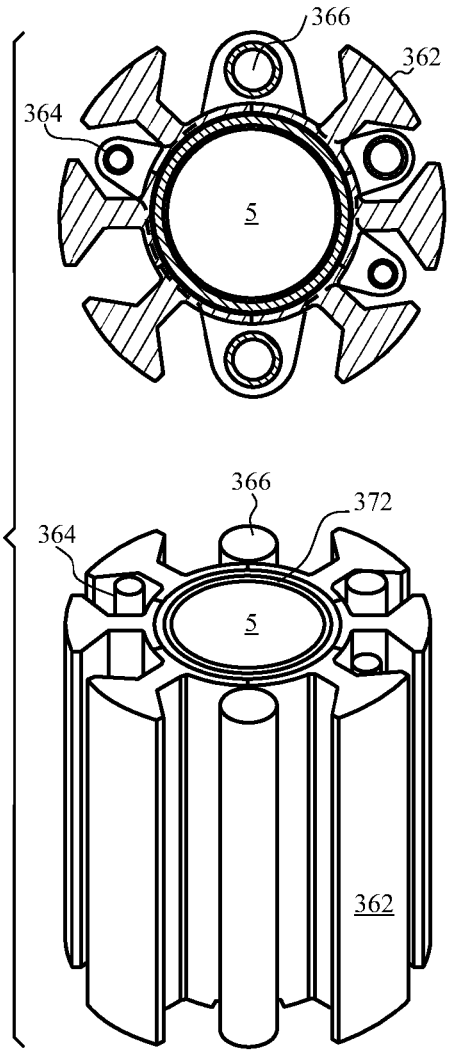
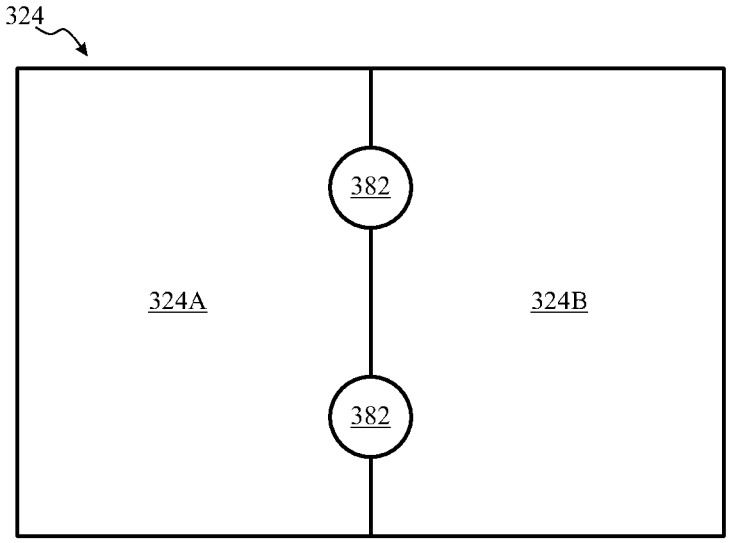
FIG. 9

SELF POSITIONING FLOATING PLATFORM AND METHOD OF USE

CROSS REFERENCE TO RELATED APPLICATIONS

This application is a Non-Provisional application claiming priority to U.S. Provisional Patent Application No. 61/968,515, entitled "Self Positioning Floating Platform and Method of Use", filed Mar. 21, 2014, which is herein incorporated by reference.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Offshore drilling rigs are often located in harsh sea environments. Often times, workers on a drilling rig are required to perform "work over the side," which is work that is performed in an open area of the drilling rig platform. One example of "work over the side" is when workers are working in a moon pool area of a drilling rig platform and attaching umbilical lines to a riser string that is being lowered through the moon pool area. Whenever performing "work over the side," safety regulations may require a rescue boat to be deployed in the sea during the time in which the work is being performed. However, sea conditions may become so harsh that the rescue boat cannot be deployed, thus preventing the "work over the side" from being performed. This results in loss of drilling rig time and added expenses. Accordingly, it would be desirable to provide systems and methods to address "work over the side" issues.

BRIEF DESCRIPTION OF DRAWINGS

FIGS. 7A-7C illustrate a roller guide assembly 350 of FIG. 6G, in accordance with an embodiment;

FIGS. 8A-8B illustrate the riser 5 of FIG. 6A, in accordance with an embodiment; and FIG. 9 illustrates a second embodiment of the floating platform of FIG. 6A, in accordance with an embodiment.

DETAILED DESCRIPTION

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to include one or more of the elements. The terms "comprising," "including," and "having" are intended to be inclusive and mean that there may be additional elements other than the listed elements.

Figure 1A:
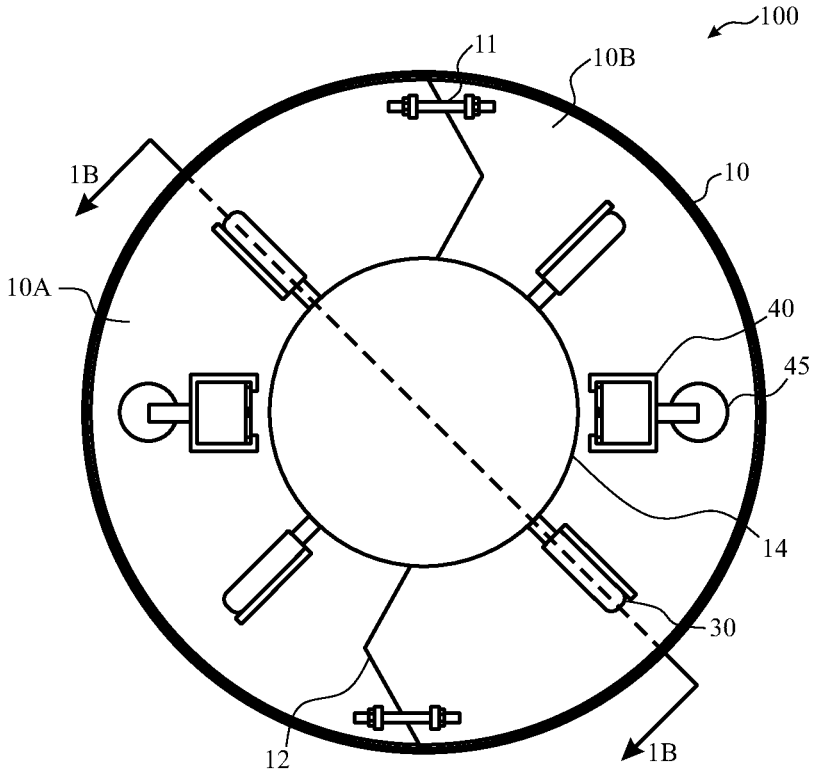
FIGS. 1A-1F illustrate a floating platform, in accordance with an embodiment.

FIGS. 1A-1F illustrate a floating platform 100 and associated elements for a drilling rig according to one embodiment. FIG. 1A illustrates a top view of the floating platform 100 comprises base 10 on which workers can stand and perform various work operations. The base 10 has a hole 14 formed in the center through which, for example, a riser may pass. The base 10 is split into a first half 10A and a second half 10B, which are coupled together by one or more locks 11, such as a manual locking device. The locks 11 may comprise any type of mechanical locking device to secure the two halves 10A, 10B together. The two halves 10A, 10B are split along a V-shaped edge 12 (as additionally illustrated in FIG. 1F, which illustrates a top view of a portion of the floating platform 100) to assist with alignment of the two halves 10A, 10B during installation. Although illustrated as having a circular shape, the base 10 and/or the hole 14 may comprise other shapes.

Figure 1B:
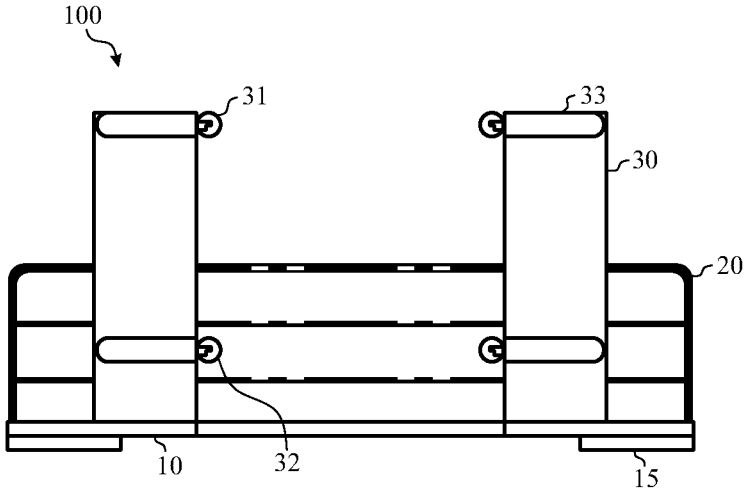

A barrier 20, such as a handrail, is illustrated in FIG. 1B (a side view of the floating platform 100) and surrounds the base 10 so that work performed on the floating platform 100 is not considered "work over the side." The barrier 20 completely surrounds any worker working on the floating platform 100. In one embodiment, a gate or other opening in the barrier 20 may be provided to allow access onto the floating platform 100. Additionally, one or more centralizers 30 are secured to the two halves 10A, 10B. The centralizers 30 allow for centering of the floating platform 100 about a riser string and allow the floating platform 100 to move with the riser string as it is deployed and retrieved, as further described below. As additionally illustrated in FIG. 1B, each centralizer 30 comprises an upper set of rollers 31, a lower set of rollers 32, each having a piston/cylinder assembly 33 to move the rollers 31, 32 radially inward and outward for engagement and disengagement with the riser string. The contour of the rollers 31, 32 may match the outer diameter of the riser string such that the rollers 31, 32 roll along the outer surface of the riser string. The rollers 31, 32 may also be shrouded or include protective type of covering to prevent the rollers 31, 32 from forming any "pinch points" when engaged with the riser string.

Figure 1C:
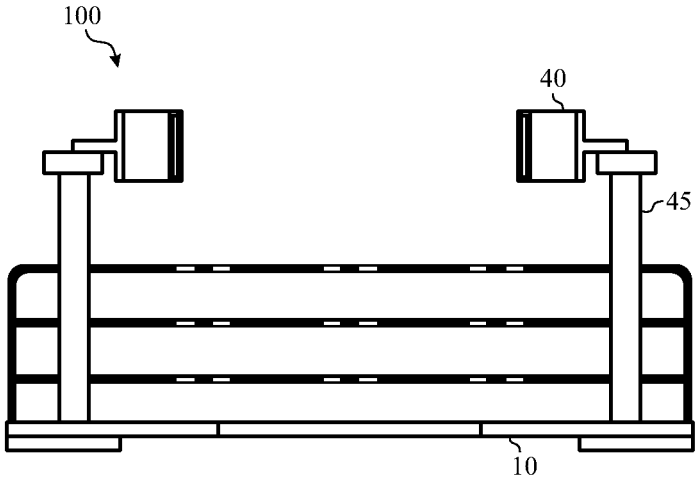

Turning to FIG. 1C, which illustrates another side view of the floating platform 100, one or more capture systems 40 are secured to one or more support members 45 that are coupled to the two halves 10A, 10B. The support member 45 may be or may include a handling pin that is used to provide an interface point for a manipulator arm (described below) to grab and move the two halves 10A, 10B during installation. Each capture system 40 is disposed to keep one of two halves 10A, 10B close to the riser string while the other one of the two halves 10A, 10B is being installed.

Figure 1D:
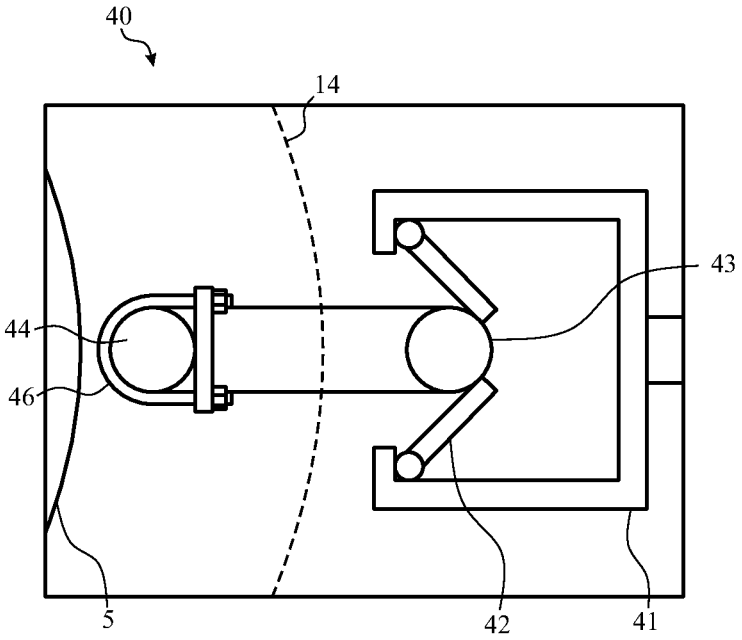

Referring to FIG. 1D, which illustrates a top view of the capture system 40, each capture system 40 comprises a housing 41 and a spring loaded locking member 42 (e.g., a carabiner type device), which allows a one-way entry of and connection to an installation pin 43 but requires manual intervention to release the installation pin 43 from the housing 41. The installation pin 43 is pre-installed on an auxiliary line 44 (e.g., a choke and kill line) by a bracket 46. The auxiliary line 44 is coupled to the outer surface of the riser string 5. The installation pin 43 and the capture system 40 assist with connecting the two halves 10A, 10B of the floating platform 100 to the riser string 5.

Figure 1E:
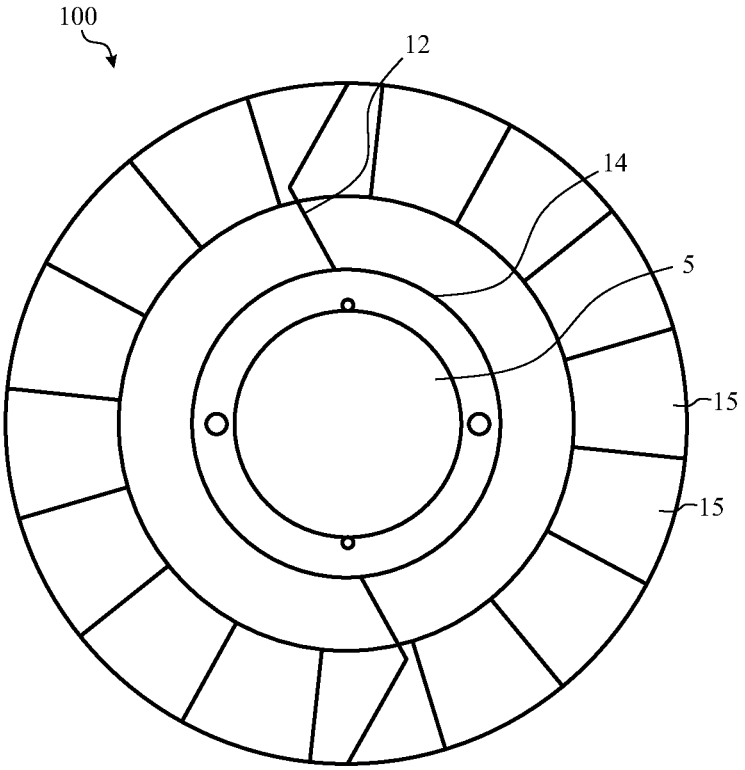
Figure 1F:
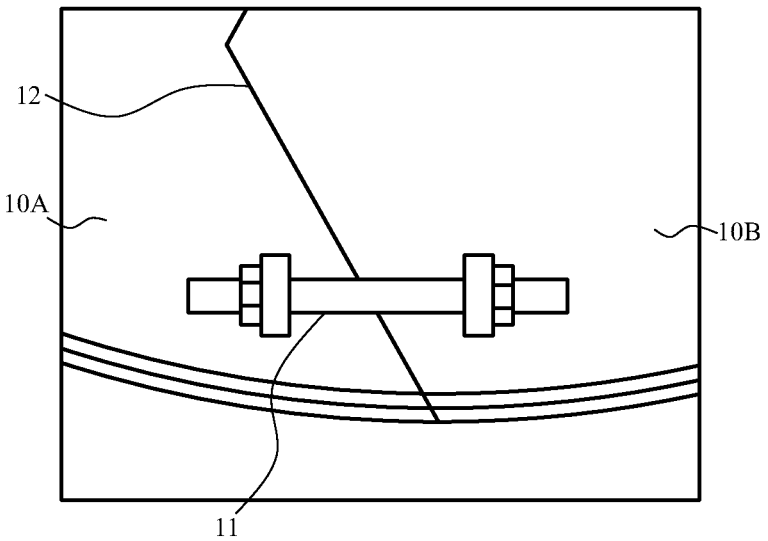

The bottom of the two halves 10A, 10B of the floating platform 100 may be fitted with one or more low friction pads 15, as illustrated in FIGS. 1B and 1E (which illustrates a bottom view of the floating platform 100). The pads 15 allow the floating platform 100 to glide or float with the motion of the riser string 5 when positioned on a fixed platform 200 as further described below. The pads 15 may be made of Teflon-graphite material and arranged in modular wedge shaped segments. In addition to the friction pads 15, or alternatively, embodiments may use other bearing or roller type systems that minimize friction between the floating platform 100 and the fixed platform 200.

Figure 2A:
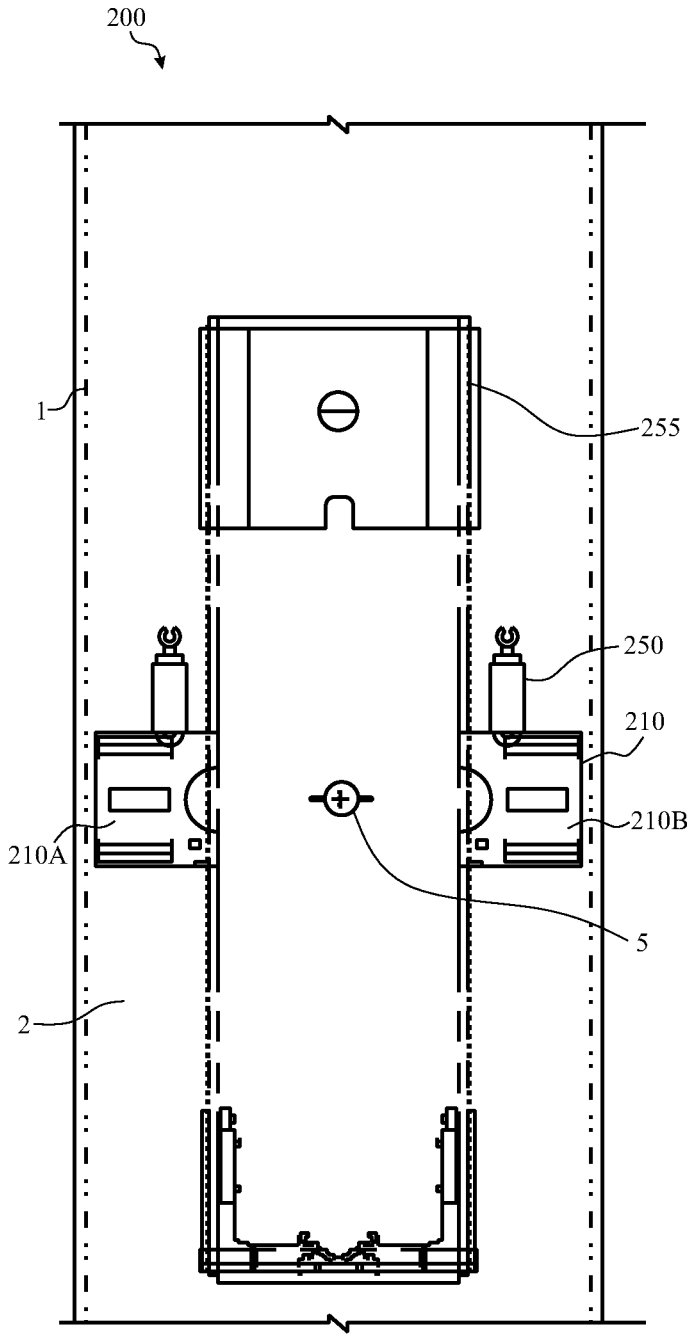
FIGS. 2A-3C illustrate a fixed platform for use in conjunction with the floating platform of FIGS. 1A-1F, in accordance with an embodiment.
Figure 2B:
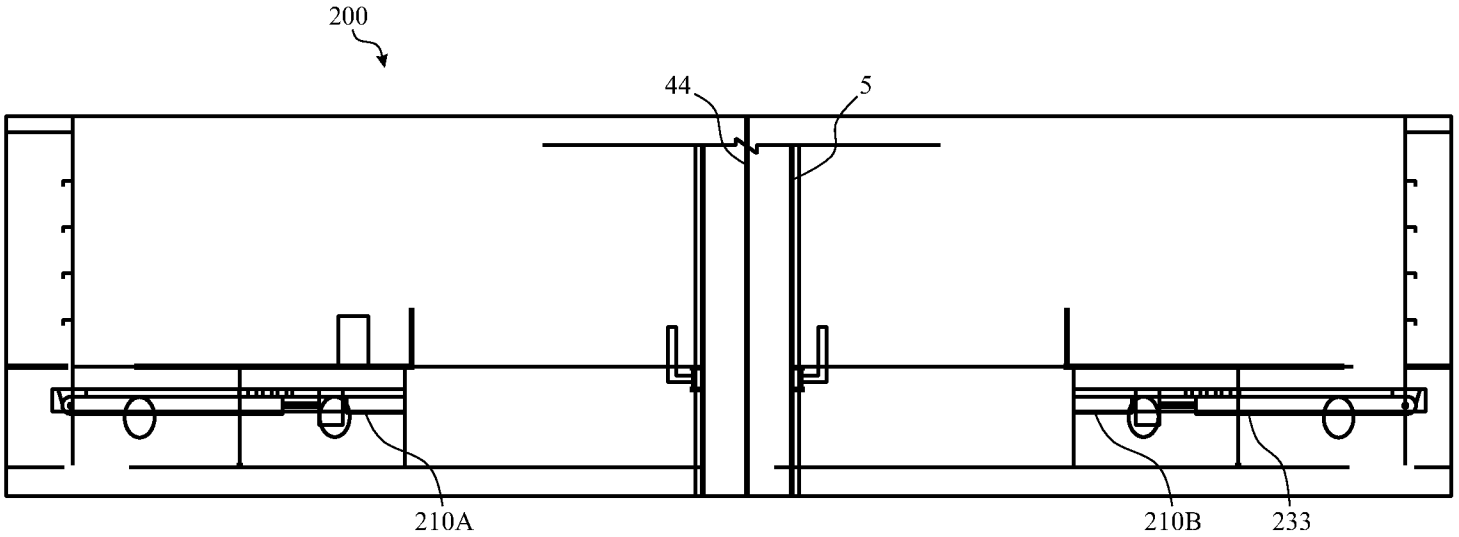
Figure 3A:
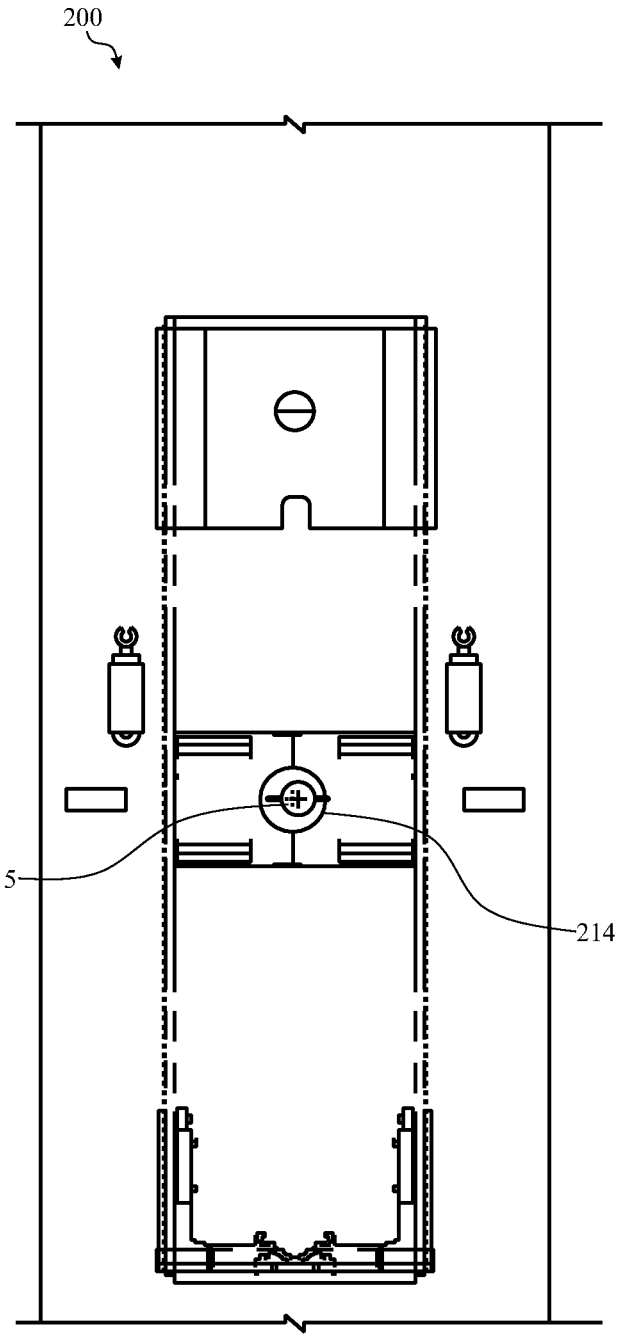
Figure 3B:
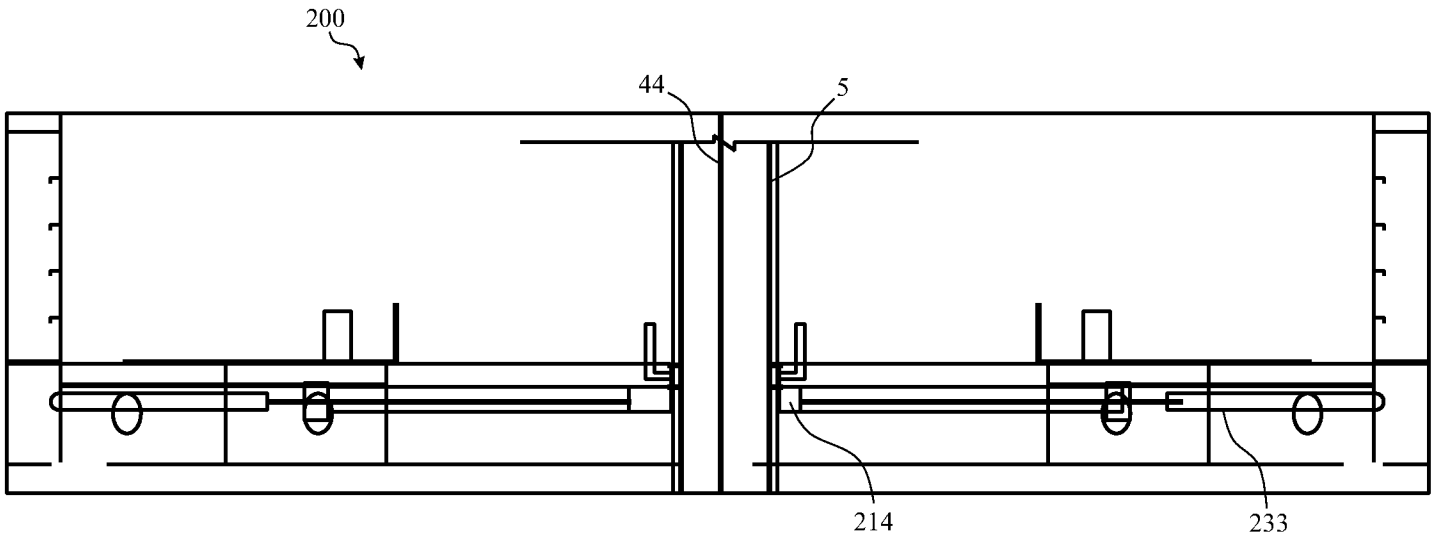
Figure 3C:
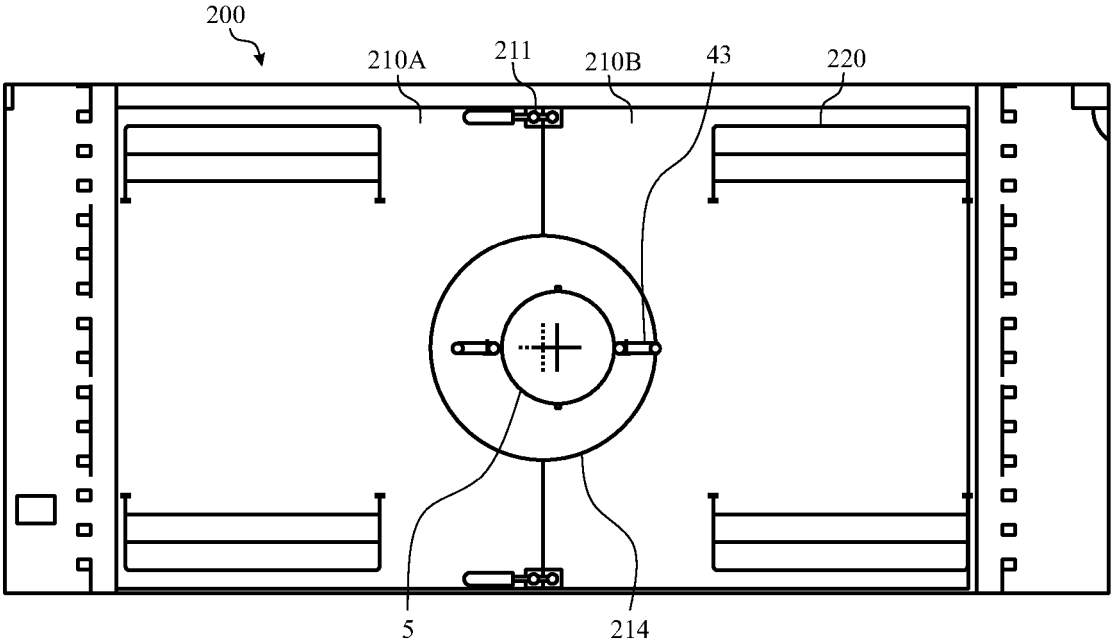

FIGS. 2A-2B and 3A-3C illustrate a fixed platform 200 for supporting the floating platform 100 according to one embodiment. The fixed platform 200 is coupled to the drilling rig 1. FIGS. 2A and 2B illustrate a top view and a side view, respectively, of the fixed platform 200 in a retracted (stowed) position below a deck 2 surrounding an open area of the drilling rig 1 known as a moon pool. FIGS. 3A-3C illustrate a top view and a side view, respectively, of the fixed platform 200 in an extended position over the moon pool (e.g., in a moon pool area) and surrounding the riser string 5. The riser string 5 is lowered and raised through the moon pool using conventional tubular handling equipment.

Work performed over the moon pool area, outside of the typical barriers or handrails along the edge of deck 2, is considered "work over the side" because the open sea is below. This work is typically performed from temporary platforms whilst wearing fall-arrest equipment or from a work access basket whilst wearing fall arrest equipment. Embodiments described herein are directed to allowing workers to work in the moon pool area in a manner that the work performed is not considered "work over the side." Specifically, by using the floating platform 100 and the fixed platform 200 as described herein, the workers are fully secured within an enclosed work environment which includes barriers or handrails (which may be higher than standard height) that completely surround the workers at all times.

Referring to FIGS. 2A and 2B (a top view of the fixed platform 200 in a storage position and a side view of the fixed platform 200 in a storage position, respectively) the fixed platform 200 comprises a base 210 on which workers can stand and perform various work operations. The base 210 is formed by a first half 210A and a second half 210B. The first and second halves 210A, 210B are movable into and out of engagement with each other by a piston/cylinder assembly 233. The fixed platform 200 provides a stable deck for supporting the floating platform 100. Although illustrated as having a rectangular shape, the base 210 may comprise other shapes. Although the fixed platform 200 is described herein as being extended and retracted using the piston/cylinder assembly 233, according to another embodiment, the fixed platform 200 may comprise removable fixed panels that are manually lowered and affixed into position when needed. According to another embodiment, the two halves 210A, 210B of the fixed platform 200 or the entire fixed platform 200 may fold vertically against the deck 2 and articulate into a fixed, hang off, working position.

One or more manipulator arms 250 may be coupled to the deck 2 (or to another area on the drilling rig 1) to assist with installing the floating platform 100 onto the fixed platform 200. Although manipulator arms 250 are illustrated, other conventional rig handling equipment and devices may be used to position the floating platform 100 onto the fixed platform 200. A transporter cart 255 that is movable along the deck 2 may also be used to assist with moving the floating platform 100 next to the fixed platform 200. The riser string 5 and the auxiliary line 44 coupled to the outer surface of the riser string 5 are positioned between the first and second halves 210A, 210B of the fixed platform 200 through the moon pool.

Referring to FIGS. 3A-3C (a top view of the fixed platform 200 in an extended position, a side view of the fixed platform 200 in an extended position, and a second top view of the fixed platform 200 in an extended position, respectively), the two halves 210A, 210B of the fixed platform 200 are moved into the extended position by the piston/cylinder assemblies 233 and brought together to form the complete base 210. At the center of the base 210 is a hole 214 through which the riser string 5 passes. The hole 214 is sized to allow the riser string 5 to have some lateral movement as illustrated in FIG. 3C. In one embodiment, the hole 214 may be sized to allow the riser string 5 to have up to about 5 degrees of angular motion relative to the point where the riser string 5 hangs off from the drilling rig 1. Also illustrated is the installation pin 43 coupled to the umbilical line 44 positioned alongside the riser string 5 to assist with installing the floating platform 100 as further described below.

Referring to FIG. 3C, the two halves 210A, 210B may be coupled together by one or more locks 211, such as remotely controlled hydraulic locks. The locks 211 may comprise any type of locking device to secure the two halves 210A, 210B together. One or more barriers 220, such as handrails, may be coupled to the fixed platform 200. The barriers 220 may be movable between a substantially horizontal position (such that they are recessed into the base 210 of the fixed platform 200) when not in use and a substantially vertical position (to provide protection to workers on the fixed platform 200) when in use.

Figure 4A:
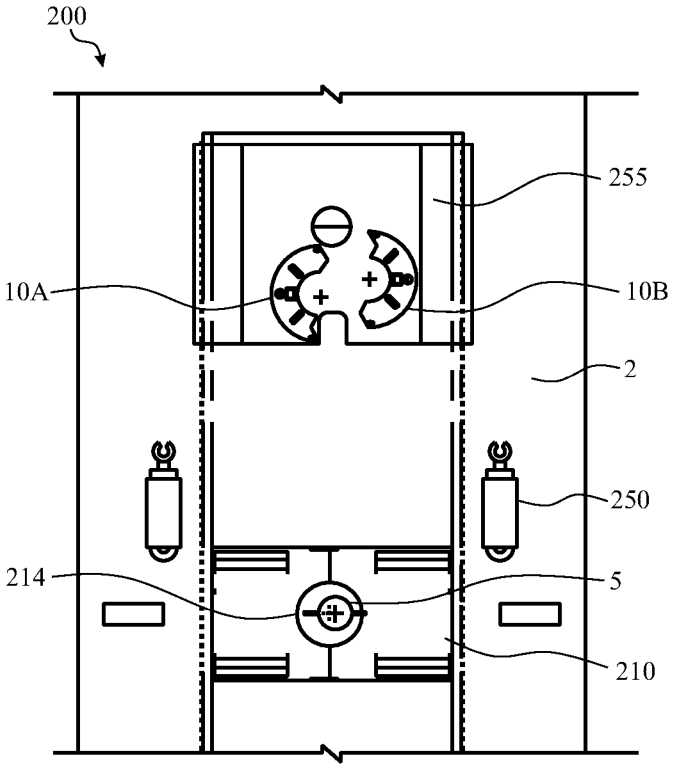
FIGS. 4A-4E illustrate an operational sequence of installing the floating platform of FIGS. 1A-1F onto the fixed platform of FIGS. 2A-3C, and positioning the floating platform into engagement with a riser string, in accordance with an embodiment.

FIGS. 4A-4E illustrate an operational sequence of installing the floating platform 100 of FIGS. 1A-1F onto the fixed platform 200 of FIGS. 2A-2B and 3A-3C, and positioning the floating platform 100 into engagement with the riser string 5. Referring to FIG. 4A (a top view of the two halves 10A, 10B of floating platform 100 in a storage position), the fixed platform 200 is in the extended position with the riser string 5 positioned within the hole 214 of the base 210 of the fixed platform 200. The two halves 10A, 10B of the floating platform 100 are loaded onto the transporter cart 255.

Figure 4B:
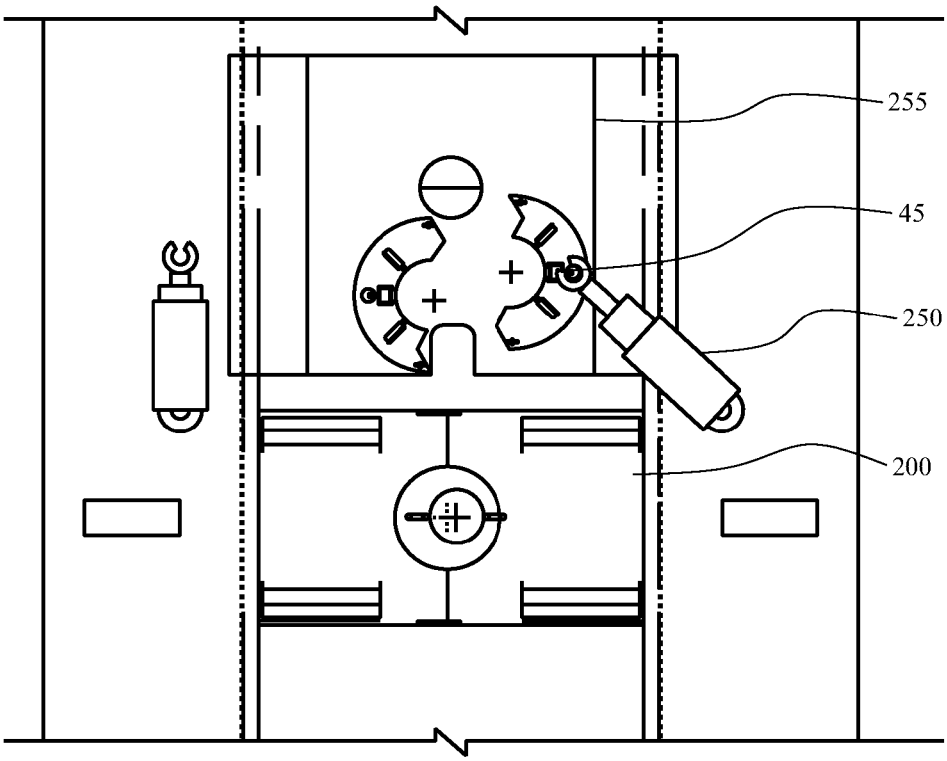

Referring to FIG. 4B, the transporter cart 255 moves the floating platform 100 next to the fixed platform 200 for handling by the manipulator arms 250. The manipulator arms 250 may pick up or push the first and second halves 10A, 10B by the support member 45. The floating platform 100 is moved from the transporter cart 255 to the fixed platform 200.

Figure 4C:
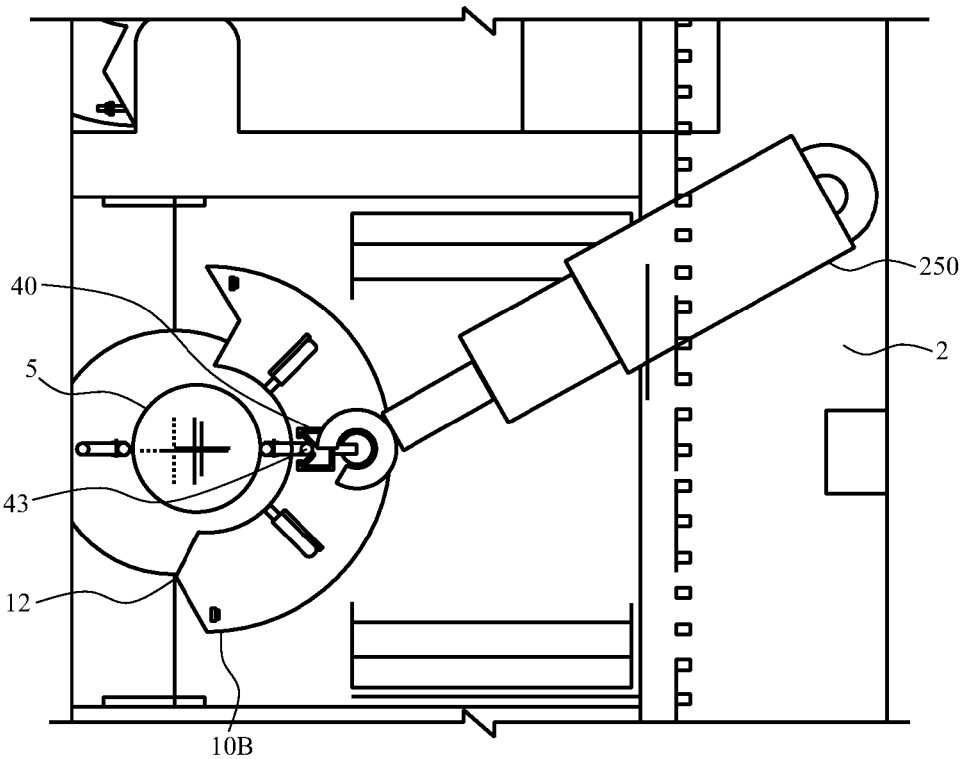

Referring to FIG. 4C, the manipulator arms 250 guide each of the two halves 10A, 10B into a position where the installation pin 43 engages the capture system 40 to retain each half 10A, 10B to the riser string 5 (also illustrated in FIG. 1D). This allows the floating platform 100 to float and move with the motion of the riser string 5 while staying retained to the riser string 5. When one half 10A, 10B is installed, the other half 10A, 10B may be installed in a same manner. The V-shaped edges 12 of each half 10A, 10B assist with aligning and centralizing the two halves 10A, 10B together.

Figure 4D:
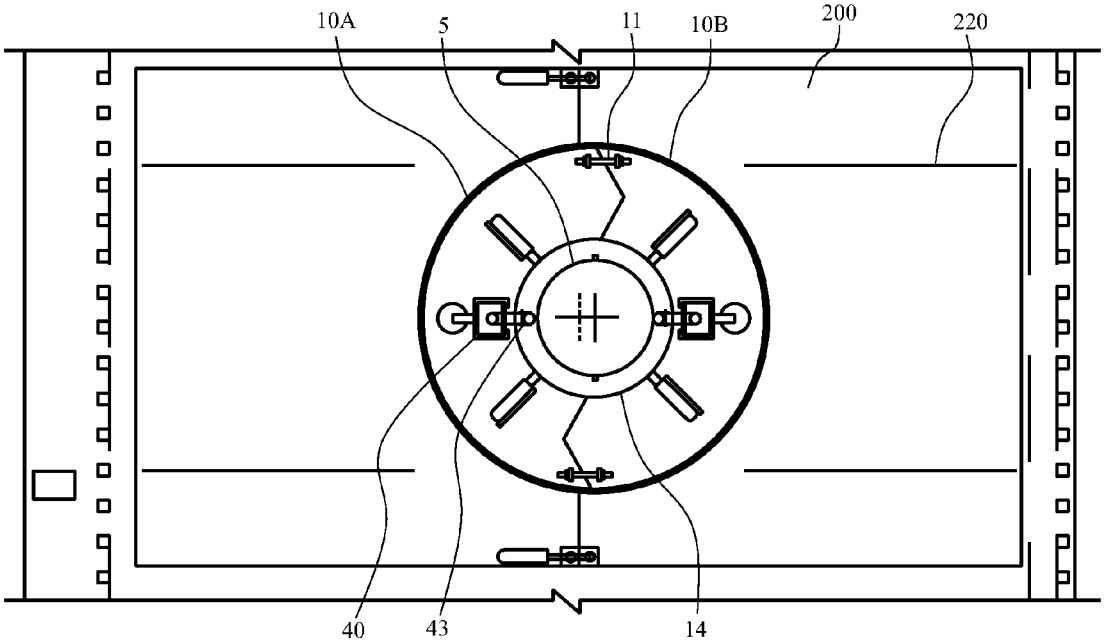

Referring to FIG. 4D, the two halves 10A, 10B are each secured to the riser string 5, which is positioned through the hole 14 of the floating platform 100. The locks 11 may be actuated remotely to secure the two halves 10A, 10B together. The manipulator arms 250 can be moved out of the way, and the gates 220 of the fixed platform 200 can be moved from the substantially horizontal position (flush with the base 210 of the fixed platform 200) to the substantially vertical position. The gates 220 assist workers to safely move to the floating platform 100. The installation pins 43 can also be removed from engagement with the capture systems 30 of each half 10A, 10B of the floating platform 100.

Figure 4E:
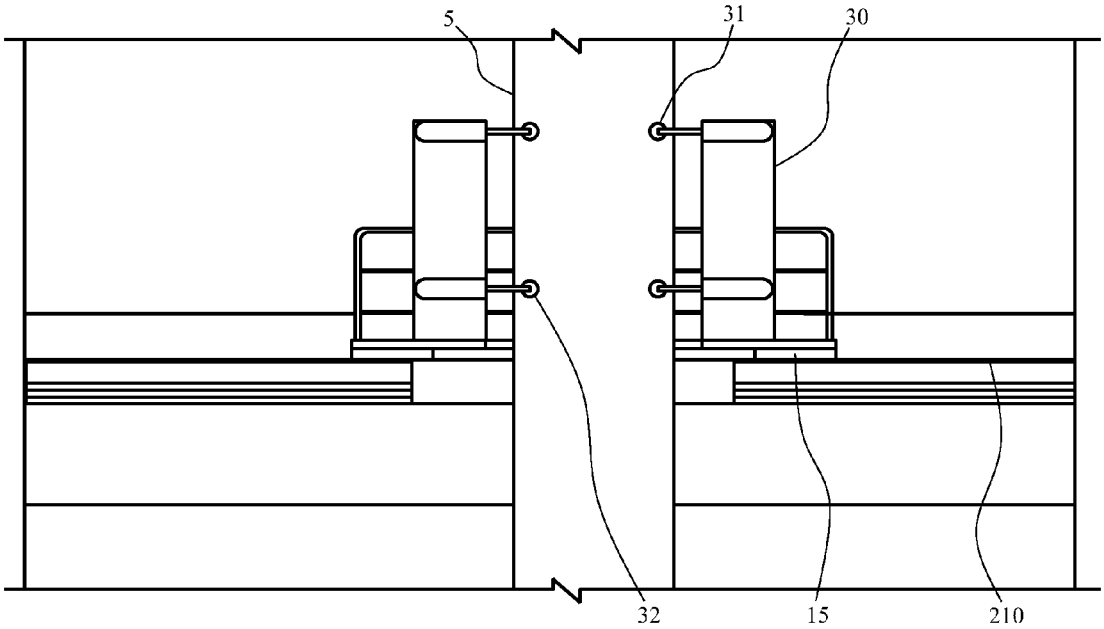

Referring to FIG. 4E (a side view of the centralizers 30), the pads 15 of the floating platform 100 contact the base 210 of the fixed platform 200 to minimize friction and prevent metal to metal wear between the floating platform 100 and the fixed platform 200. The pads 15 may also be replaceable to account for wear over time. The centralizers 30 are actuated into engagement with the riser string 5. Specifically, the upper and lower rollers 31, 32 are moved radially into contact with the outer surface of the riser string 5. The upper and lower rollers 31, 32 roll along the outer surface of the riser string 5 to allow the riser string 5 to be raised and lowered relative to the floating platform 100. In one embodiment, one or more guide members may be mounted to the riser string 5 to provide a constant path along which the rollers 31, 32 can engage. Lateral (horizontal) movement of the riser string 5, however, is transferred to the floating platform 100 by the centralizers 30. The floating platform 100 floats on top of and moves relative to the fixed platform 200 with lateral movement of the riser string 5.

Figure 5A:
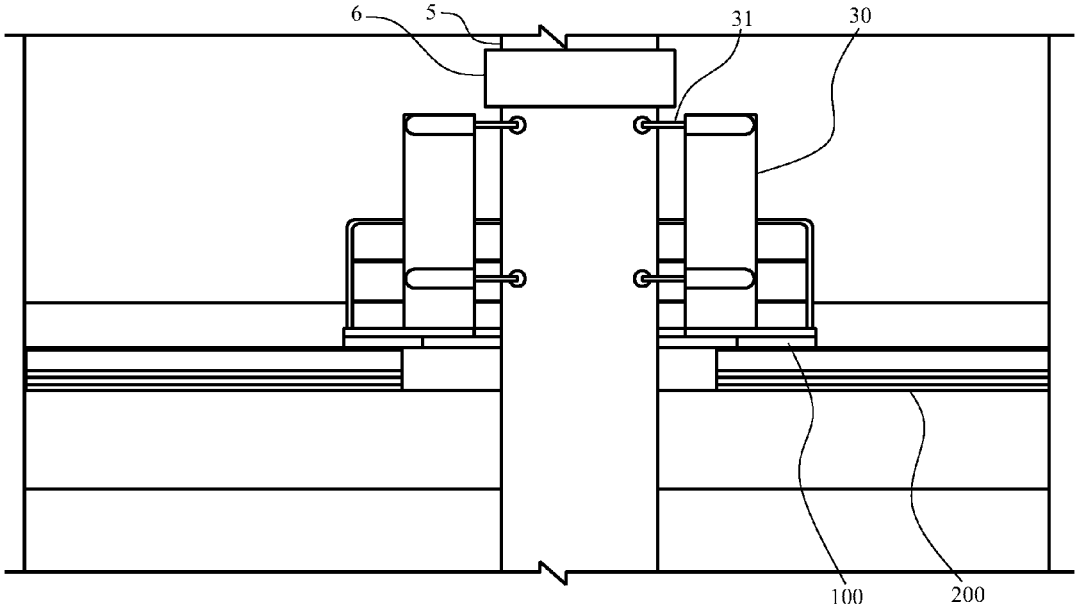
FIGS. 5A-5C illustrate an operational sequence of moving a riser string flange through the floating and fixed platforms of FIGS. 1A-1F and FIGS. 2A-3C, in accordance with an embodiment.
Figure 5B:
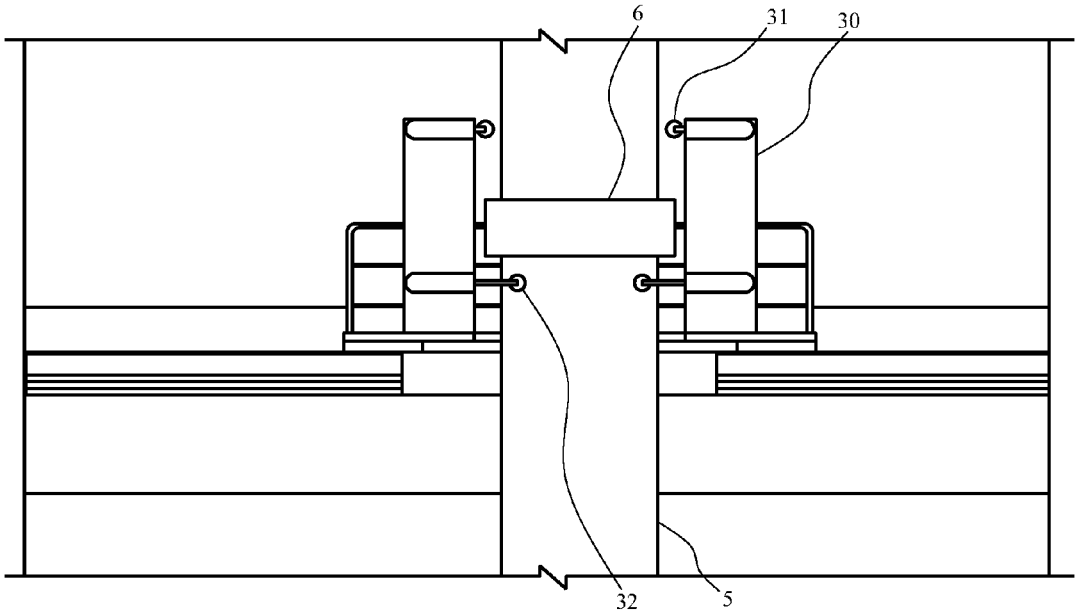
Figure 5C:
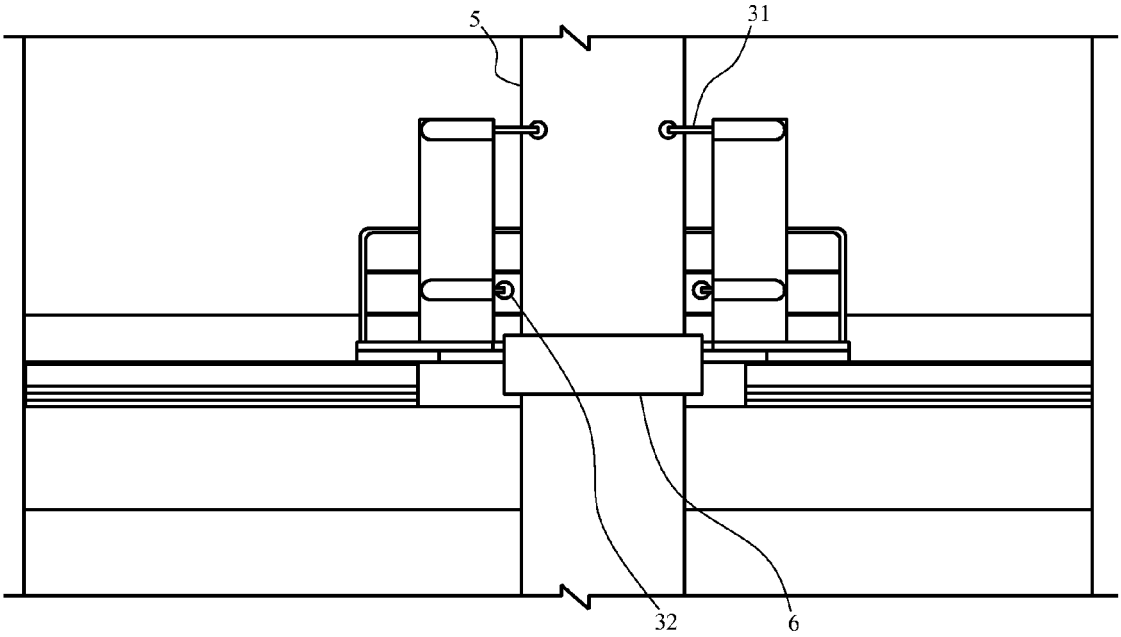

FIGS. 5A-5C illustrate an operational sequence of moving a riser string flange 6 of the riser string 5 through the floating platform 100 and the fixed platform 200. The riser string 5 is comprised of multiple tubular members joined together. The ends of the tubular members may be connected together by a bolted, flanged connection. Since each riser string flange 6 has an outer diameter that is greater than the outer diameter of the riser string 5, the centralizers 30 have to be adjusted to allow each riser string flange 6 to pass through the floating platform 100.

Referring to FIG. 5A (a second side view of the centralizers 30), the riser string 5 is lowered through the floating platform 100 and the fixed platform 200. All of the centralizers 30 are engaged with the riser string 5. As the riser string flange 6 approaches the floating platform 100, the centralizers 30 need to be sequenced to pass the riser string flange 6 through the floating platform 100. Otherwise, the riser string flange 6 may contact the upper rollers 31 and force the floating platform 100 and the fixed platform 200 in a downward direction, potentially damaging the platforms 100, 200 and the drilling rig.

Referring to FIG. 5B (a third side view of the centralizers 30), the upper rollers 31 of the centralizers 30 are retracted to allow the riser string flange 6 to be lowered through. The riser string flange 6 is lowered into a position between the upper rollers 31 and the lower rollers 32. The lower rollers 32 are still in engagement with the riser string 5. When the riser string flange 6 passes the upper rollers 31, the upper rollers 31 may be extended back into engagement with the riser string 5.

Referring to FIG. 5C (a fourth side view of the centralizers 30), the upper rollers 31 are extended into engagement with the riser string 5. The lower rollers 32 are retracted to allow the riser string flange 6 to continued to pass through the floating platform 100. When the riser string flange 6 passes the lower rollers 32, the lower rollers 32 may be extended back into engagement with the riser string 5. In one embodiment, the centralizers 30 may comprise shrouded spring-loaded rollers on rocker arms that automatically extend and retract as the riser string flanges 6 pass through the floating platform 100.

As the riser string 5 is deployed or retrieved the centralizers 30 are extended and retracted in this manner to allow the riser string flanges 6 or any other enlarged outer diameter areas on the riser string 5 to pass through the floating platform 100. The floating platform 100 and the fixed platform 200 allow rig workers to attach umbilical lines to the outer surface of the riser string 5 in a protected area that is fully enclosed by the gate 20. This protected area avoids the need for having to deploy a rescue boat when work is being performed in the moon pool area. Additionally, as will be described below, work being performed in the moon pool area may be accomplished without exposing workers directly to the sea below, as the fixed platform 200 and floating platform 100 shall be underfoot of workers in the moon pool area. In this manner, the work performed over the moon pool area is not considered to be "work over the side."

Figure 6A:
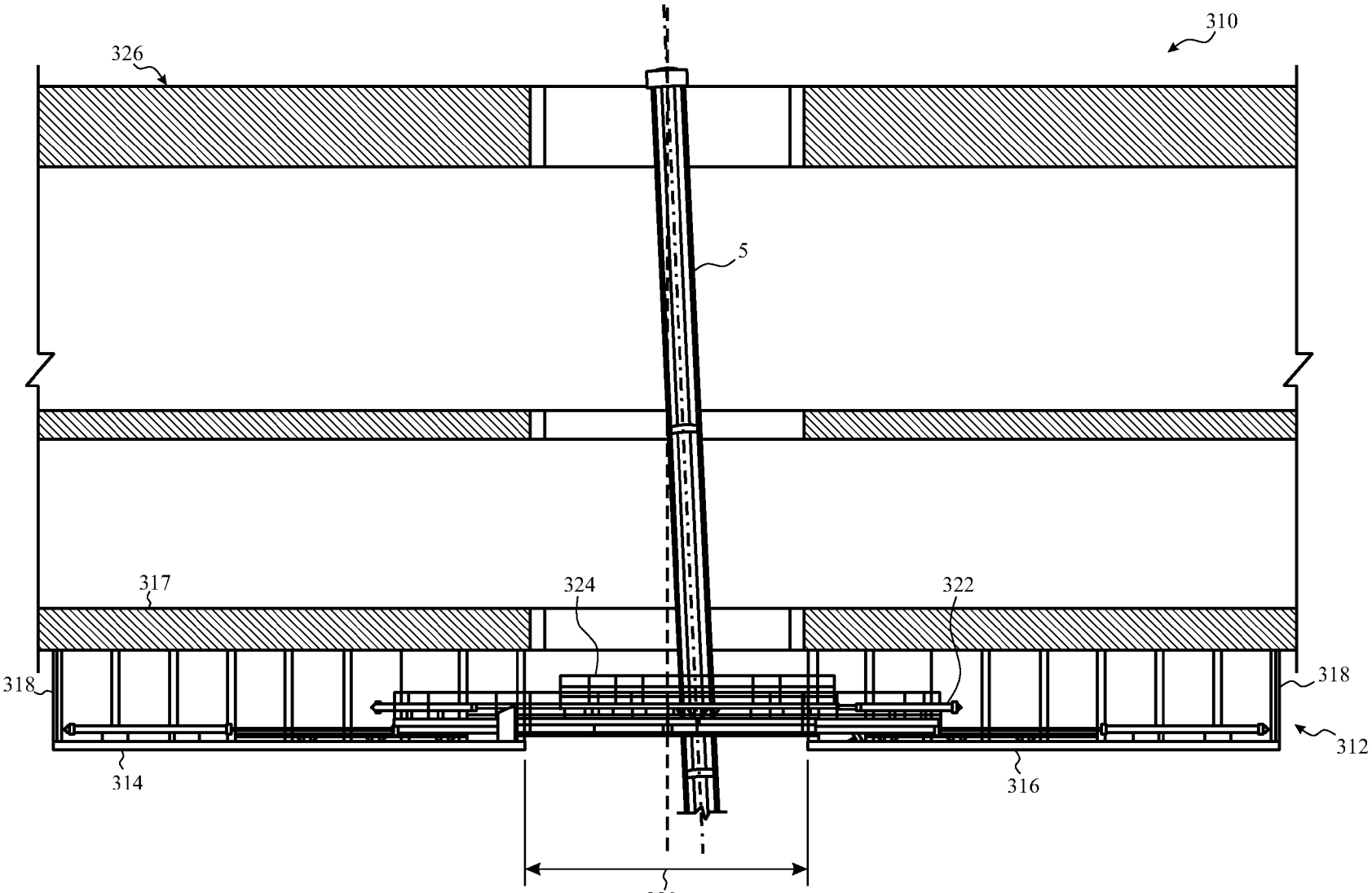
FIGS. 6A-6G illustrate a riser access platform, in accordance with an embodiment.

FIG. 6A illustrates a side view of an offshore platform, such as a semi-submersible platform 310. Indeed, although the presently illustrated embodiment of the offshore platform is a semi-submersible platform 310 (e.g., offshore semi-submersible drilling rig), other offshore platforms such as a drillship, a floating production system, or the like may be substituted for the semi-submersible platform 310 such that the techniques and systems described below are intended to cover at least the additional above-noted offshore platforms.

As illustrated in FIG. 6A, the semi-submersible platform 310 may include a riser access platform 312. The riser access platform 312 may include a platform housing 314 (e.g., disposed below a moon pool of the semi-submersible platform 310) that includes at least one bottom portion 316 extending, for example, in a parallel direction with the deck 317 different deck 317 this one is bottom and at least one side portion 318 extending, for example, in a perpendicular direction to the deck 317. In some embodiments, a space 320 (e.g., a moon pool area inclusive of a moon pool for the riser 5 to pass through) may separate the bottom portion 316 of the platform housing 314. In one embodiment, the side portion 318 may fully surround the at least one bottom portion 316 so as to shield the internal space of the riser access platform 312 from natural elements (e.g., water, wind, etc.).

In other embodiments, the side portion 318 may surround the perimeter of each bottom portion 316 up to space 320. In this embodiment, a vertical aperture may exist between each bottom portion 316 and the deck 317 along each edge of the space 320. This aperture may be covered, for example, by a watertight retractable covering (not illustrated) that may extend from each bottom portion 316 towards the deck 317 and may have a height approximately equal to side portion 318. This retractable covering may be a moveable covering that can be moved from a primarily vertical extended position (shielding the internal space of the riser access platform 312 from natural elements) into a primarily horizontal retracted position (along the horizontal length of the deck 317) in a manner similar to a home garage door to allow for the techniques described below to be performed.

In at least one embodiment, the retractable covering may be disposed along each edge of space 320 and may form a barrier (along with bottom portion 316 and side region 318) for internal space of the riser access platform 312. In a further embodiment, two separate portions (each inclusive of a distinct bottom portion 316, a distinct side portion 318 [which may include three portions coupled together along the bottom portion 316 or a single portion along the bottom portion 316], and a distinct retractable portion) may be combined to form the platform housing 314. Additionally, in some embodiments, the side portion 318 may extend partially along the edge of space 320 such that the retractable covering does not fully extend along the edge of space 320.

The riser access platform 312 houses a moveable platform 322 and a floating platform 324 that is movably coupled to the moveable platform 322 (e.g., the floating platform 324 may move in one or more directions with respect to the movable platform 322 while being coupled to the movable platform 322). As will be described in greater detail below, the moveable platform 322 and the floating platform 324 may operate in conjunction to allow work to be performed on riser 5 without the work constituting "work over the side." As illustrated in FIG. 6A, each of the moveable platform 322 and the floating platform 324 are illustrated as being disposed beneath the deck 317. However, in other embodiments, each of the moveable platform 322 and the floating platform 324 (as well as the related elements described hereinafter) may instead be disposed on the deck 317, on or below the drill floor 326, or in another area of the semi-submersible platform 310. Likewise, for example, the moveable platform 322 and the floating platform 324, when utilized in a drillship, may be located in the hull of the drillship.

Figure 6B:
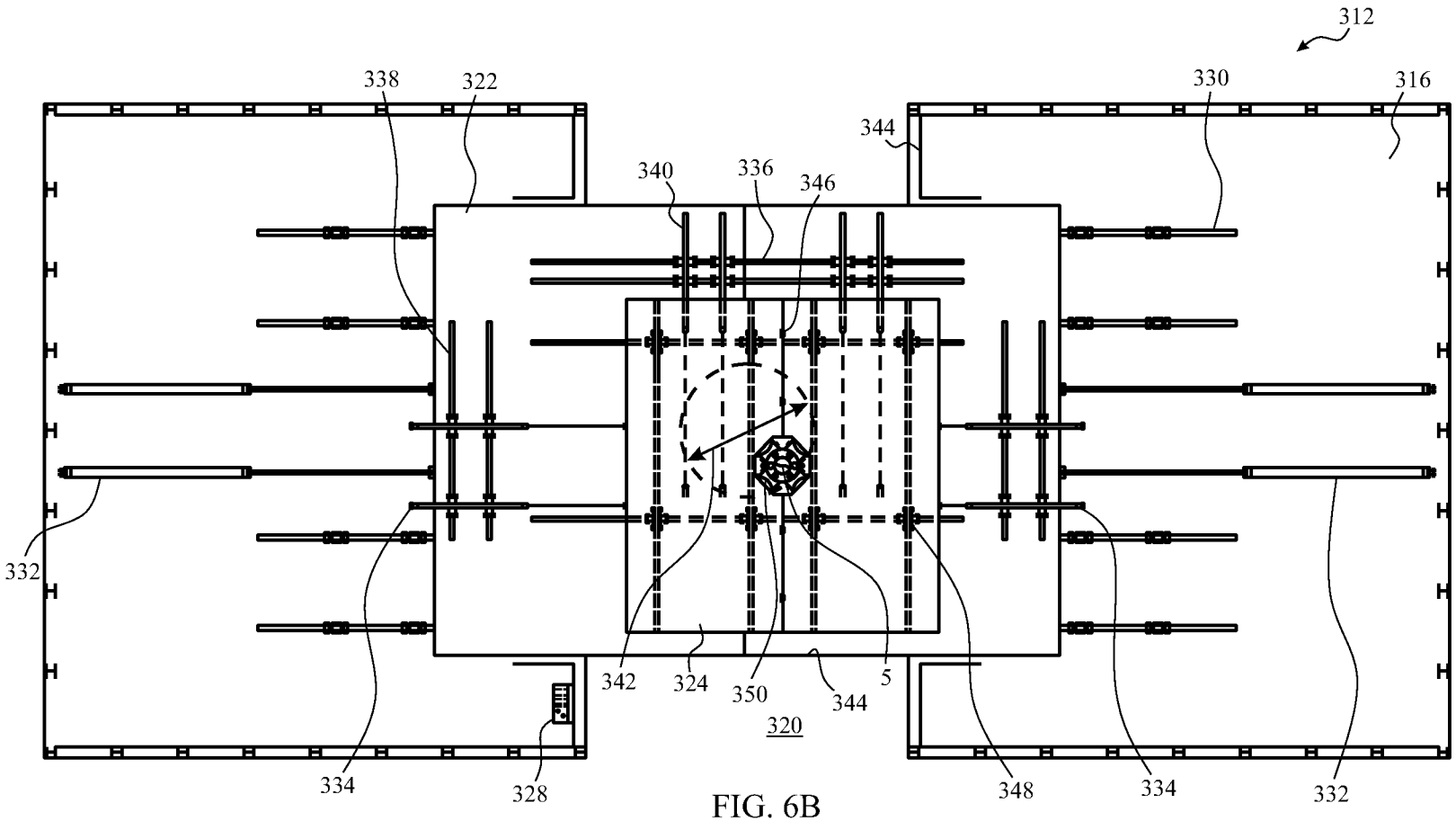

FIG. 6B illustrates a top view of the riser access platform 312. As illustrated, the riser access platform includes the bottom portion 316, the moveable platform 322, and the floating platform 324. As illustrated, the moveable platform 322 and the floating platform 324 are in their extended positions. In some embodiments, a control panel 328 may be provided to control, for example, the movement of each of the moveable platform 322, and the floating platform 324 into their extended and retracted positions. It should be noted that the control panel 328 may operate in conjunction with software systems implemented as computer executable instructions stored in a non-transitory machine readable medium such as memory, a hard disk drive, or other short term and/or long term storage in the control panel 328. Particularly, the techniques to operate the control panel 328 may be performed using code or instructions stored in a non-transitory machine-readable medium (e.g., the memory and/or storage) and may be executed, for example, by the one or more processors or a controller of control panel 328. Accordingly, the controller of the control panel 328 may be read as an application specific integrated circuit (ASIC), one or more processors, or another processing device that interacts with memory one or more tangible, non-transitory, machine-readable media that collectively stores instructions executable by the controller the method and actions described herein. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by the processor or by any general purpose or special purpose computer or other machine with a processor. In some embodiments, control of the controller via the control panel 328 may be performed by a user utilizing one or more user inputs (keys, buttons, joystick, a graphical user interface, etc.).

Additionally, to facilitate movement of separate portions of the moveable platform 322, the riser access platform 312 may include platform extend and retract platform tracks 330 that guide the portions of the moveable platform 322 along the bottom portion 316. The riser access platform 312 may also include one or more linear actuators 332 that provide motion in a straight line to allow for the extension and retraction of the portions of the moveable platform 322 along extend and retract platform tracks 330. In one embodiment, each linear actuator 332 may include a hydraulic cylinder. In some embodiments, the operation of each linear actuator 332 may be controlled by the control panel 328. For example, in one embodiment, the moveable platform 322 may include two separate portions each moved by one or more linear actuators 332 concurrently such that movement of each portion of the moveable platform 322 is common (e.g., performed at a common speed). In this manner, the one or more linear actuators 332 may operate to extend and retract portions of the moveable platform 322 for storage and for operation.

As additionally, as illustrated in FIG. 6B, the moveable platform 322 may include secondary linear actuators 334. The secondary linear actuators 334 may facilitate retraction and extension of separate portions of the floating platform 324 to allow for connection and disconnection of the portions of the floating platform 324 along floating platform extend and retract tracks 336 that guide the separate portions of the floating platform 324 along the moveable platform 322. In one embodiment, each linear actuator 334 may include a hydraulic cylinder and the operation of each linear actuator 334 may be controlled by the control panel 328. For example, in one embodiment, the floating platform 324 may include two separate portions each moved by one or more linear actuators 334 concurrently such that movement of each portion of the floating platform 324 is common (e.g., performed at a common speed). In this manner, the one or more actuators 334 may operate to extend and retract portions of the floating platform 324 for operation and for storage.

In one embodiment, the one or more actuators 334 may be positioned on one or more secondary actuator tracks 338 that allow for the movement of the actuators 334 to maintain a relative position with the floating platform 324 (e.g., so that the actuators 334 remain generally disposed about the riser 5). In some embodiments, the actuators 334 may also be utilized to control motion of the floating platform 324. For example, the control panel 328 may cause the actuators 334 to provide a resistance force against the floating platform 324 when the floating platform moves in a linear direction towards a respective actuator 334. In some embodiments, the amount of resistance force is inversely proportional to the distance from the floating platform 324 to the respective actuator 334 (e.g. as the distance between the floating platform 324 and the respective actuator 334 decreases, the pressure applied to the floating platform 324 by the respective actuator 334 increases). In some embodiments, one or more sensors may be utilized to measure and/or detect the movement of the floating platform 324 and transmit an indication of the movement to the control panel 328, which may generate a signal to control a respective actuator 334 to provide a predetermined resistance force, as described above. In other embodiments, the one or more actuators 334 may be passively controlled and set up to provide a predetermined resistance force in response to the movement of the floating platform 324.

Additionally, as illustrated in FIG. 6B, platform 324 may include one or more floating platform linear actuators 340. The floating platform linear actuators 340 may be positioned on the floating platform extend and retract tracks 336 to allow for the movement of the actuators 340 to maintain a relative position with the floating platform 324 (e.g., so that the actuators 340 remain generally disposed about the riser 5). In some embodiments, the actuators 340 may also be utilized to control motion of the floating platform 324. For example, the control panel 328 may cause the actuators 340 to provide a resistance force against the floating platform 324 when the floating platform moves in a linear direction towards or away from the actuators 340. In some embodiments, the amount of resistance force may be related to the distance from the floating platform 324 to the actuators 340 (e.g., as the distance between the floating platform 324 and the respective actuator 340 moves towards a predetermined minimum or a predetermined maximum distance value, the pressure applied to the floating platform 324 to counter the movement of the floating platform 324 by the one or more actuators 340 increases). In some embodiments, one or more sensors may be utilized to measure and/or detect the movement of the floating platform 324 and transmit an indication of the movement to the control panel 328, which may generate a signal to control the one or more actuators 340 to provide a predetermined resistance force, as described above. In other embodiments, the one or more actuators 340 may be passively controlled and set up to provide a predetermined resistance force in response to the movement of the floating platform 324 about aperture 342 of the moveable platform 322 in which riser 5 moves (e.g., in response to nature or other influences).

In one embodiment, barriers 344 (e.g., handrails, guards, or the like) may be utilized, for example, on the moveable platform 322, the floating platform 324, and/or the bottom portion 316. One or more gates or other openings in the barriers 344 may be provided to allow access of a worker onto and off of the moveable platform 322 and/or the floating platform 324. Additionally, as will be described in greater detail below with respect to FIG. 6G, the riser access platform 312 may also include an interlock system 346 that is utilized to couple the portions of the floating platform 324 together, a two dimensional (2D) roller assembly 348 that facilitates movement of the floating platform 324 when riser 5 moves in aperture 342, and a roller guide assembly 350 disposed in an aperture of the floating platform 324 that contacts riser 5. However, prior to discussion of the interlock system 346, the 2 D roller assembly 348, and the roller guide assembly 350, the sequence of the extension of the moveable platform 322 and the floating platform 324 will be discussed in relation to FIGS. 6C-6F.

Figure 6D:
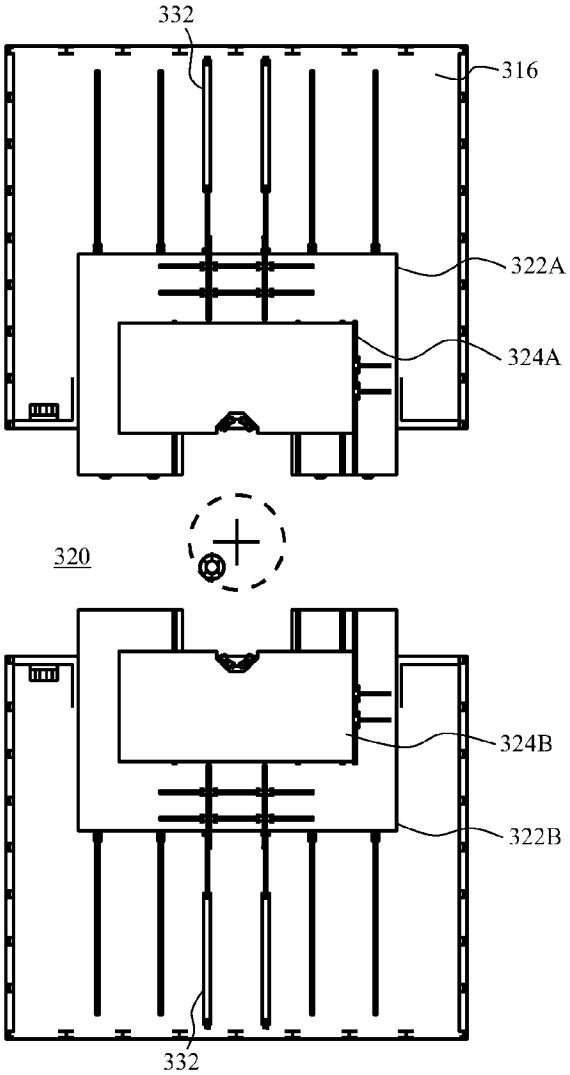
Figure 6C:
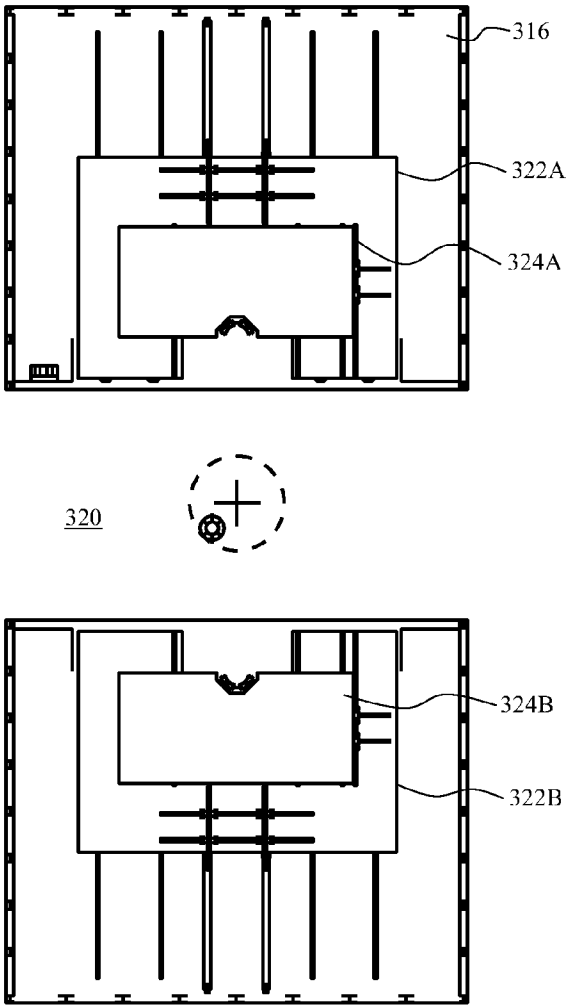

FIGS. 6C-6F illustrate top views of the moveable platform 322 and the floating platform 324 during movement from a storage position to an extended (operational position). FIG. 6C illustrates a first portion of the moveable platform 322A and a second portion of the moveable platform 322B in a storage position (e.g., non-extended from bottom portion 316). Similarly, FIG. 6C illustrates a first portion of the floating platform 324A and a second portion of the moveable platform 324B in a storage position (e.g., non-extended from bottom portion 316). In some embodiments, one or more locking mechanisms (not illustrated), such as any type of mechanical locking device may be utilized to secure each of the first portion of the moveable platform 322A and a second portion of the moveable platform 322B and/or the first portion of the floating platform 324A and the second portion of the moveable platform 324B in respective storage positions. In FIG. 6D, the one or more linear actuators 332 (e.g., as controlled by the control panel 328) may cause the first portion of the moveable platform 322A and a second portion of the moveable platform 322B to extend into space 320 (e.g., across the moon pool area).

Figure 6F:
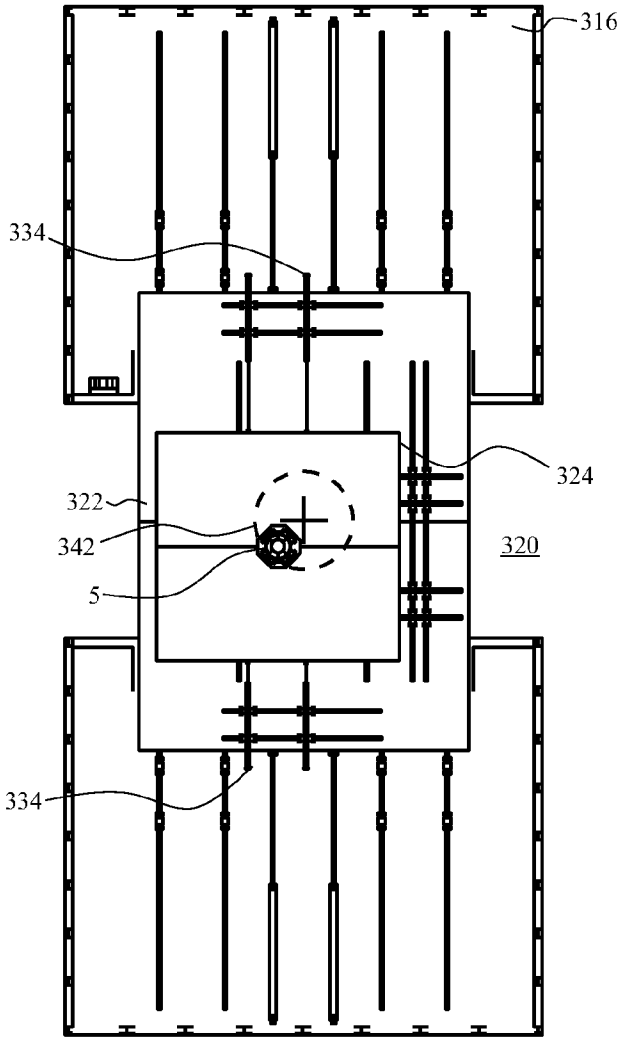
Figure 6E:
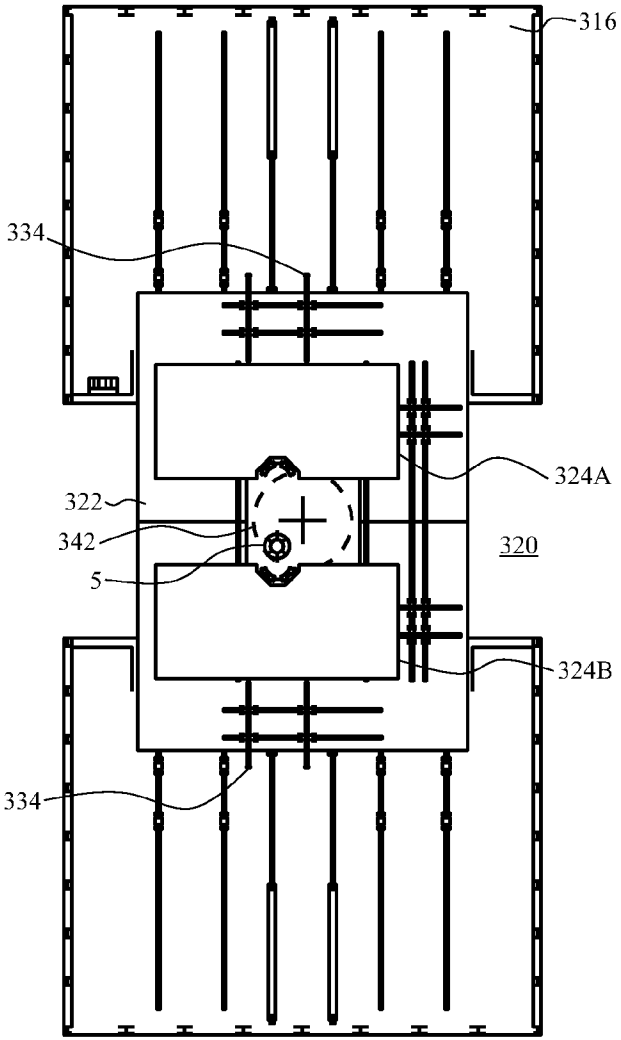

As illustrated in FIG. 6E, the one or more linear actuators 332 complete movement of the first portion of the moveable platform 322A and a second portion of the moveable platform 322B to form moveable platform 322. At this time, the one or more secondary linear actuators 334 (e.g., as controlled by the control panel 328) may cause the first portion of the floating platform 324A and the second portion of the floating platform 324B to extend over the aperture 342 of the moveable platform 322. In FIG. 6F, the one or more secondary linear actuators 334 complete movement of the first portion of the floating platform 324A and a second portion of the moveable platform 324B to form floating platform 324. Once coupled, the floating platform 324 may move about the moveable platform 322 in response to movements by the riser 5 in aperture 342 of the moveable platform 322. In this manner, one or more workers may be able to stand on the floating platform 324 to perform work on the riser 5 without the work being considered over the side work (e.g., due at least to the floating platform 324 being underfoot of the one or more workers and/or due to the enclosure of the one or more workers by barriers 344).

Figure 6G:
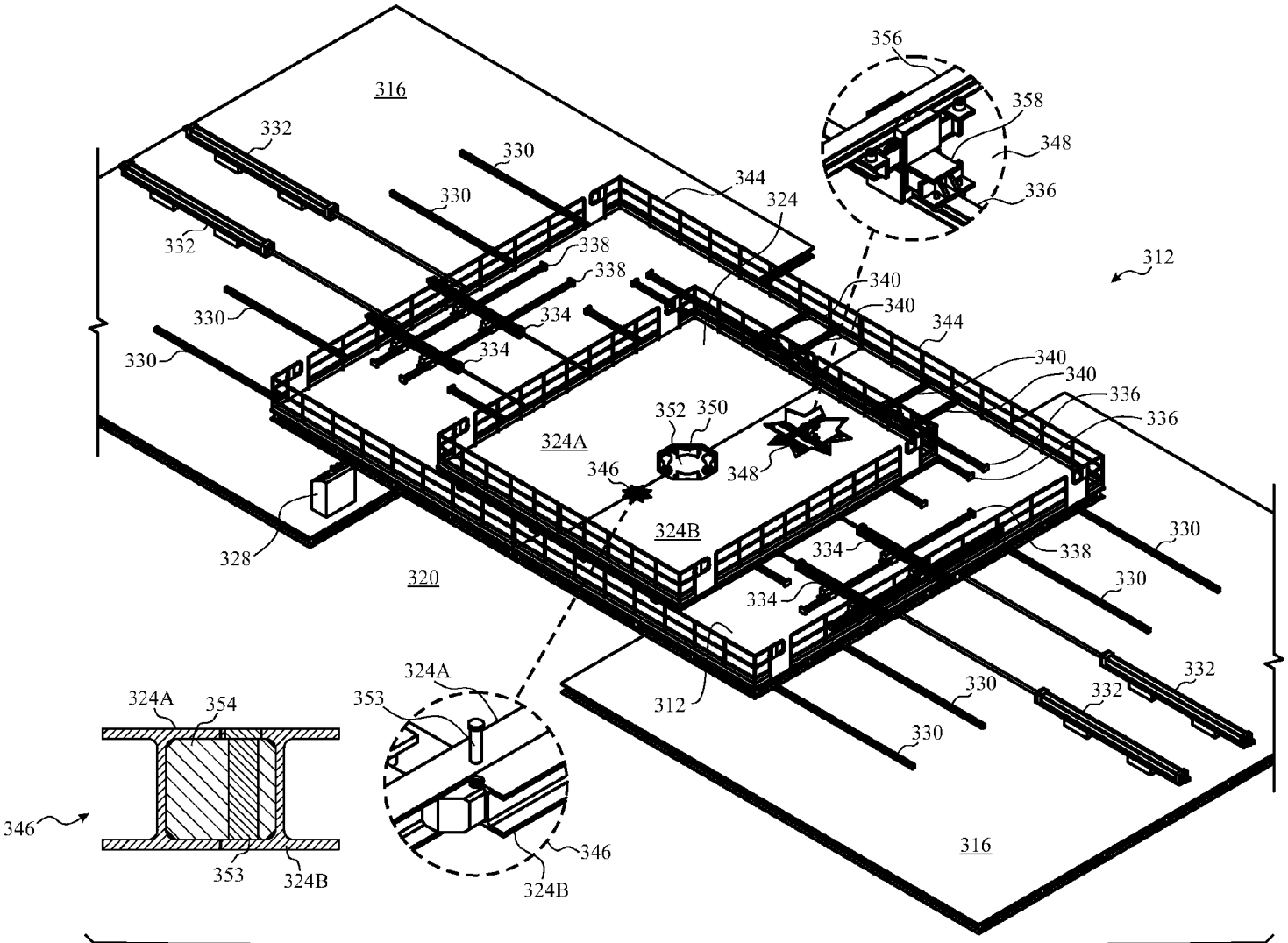

FIG. 6G illustrates an isometric view of the riser access platform 312. As previously discussed with respect to FIG. 6B, the riser access platform 312 includes an interlock system 346 (e.g., any type of locking device), which is illustrated in greater detail in FIG. 6G. The interlock system 346 includes a locking pin 353 that is utilized to couple the portions 324A and 324B of the floating platform 324 together. In some embodiments, the locking pin 353 may engage with a locking block 354 to couple the portions 324A and 324B of the floating platform 324 together. In some embodiments, the locking pin 353 may be manually or automatically inserted through the floating platform 324 and more than one interlock system 346 may be utilized in conjunction with the riser access platform 312. In another embodiment, the locking pin 353 may couple both portions 324A and 324B of the floating platform 324 together as well as portions 322A and 322B of the movable platform 322 together.

Additionally, FIG. 6G illustrates the 2D roller assembly 348 that facilitates movement of the floating platform 324 in conjunction with the movement of the riser 5 in aperture 342. The 2D roller assembly 348 includes a roller track 356 that allows for movement of the floating platform 324 in a direction generally parallel to the direction of the secondary actuator tracks 338 and generally perpendicular to the direction of the floating platform extend and retract tracks 336. The 2D roller assembly also includes a 2D motion roller assembly 358 that allows for respective motion of the floating platform 324 in two directions (e.g., in a direction generally parallel to the direction of the secondary actuator tracks 338 and in a direction generally parallel to the direction of the floating platform extend and retract tracks 336).

In some embodiments, the 2D motion roller assembly 358 may operate to allow movement of the floating platform 324 in a first direction (e.g., in a direction generally parallel to the direction of the secondary actuator tracks 338) while restricting motion in a second direction (e.g., in a direction generally parallel to the direction of the floating platform extend and retract tracks 336). The 2D motion roller assembly 358 may also operate to allow movement of the floating platform 324 in the second direction (e.g., in a direction generally parallel to the direction of the floating platform extend and retract tracks 336) while restricting motion in the first direction (e.g., in a direction generally parallel to the direction of the secondary actuator tracks 338). Alternatively, the motion roller assembly 358 may also operate to allow movement of the floating platform 324 in both the first direction (e.g., in a direction generally parallel to the direction of the secondary actuator tracks 338) and the second direction (e.g., in a direction generally parallel to the direction of the floating platform extend and retract tracks 336). Moreover, as previously discussed, the motion of the floating platform 324 may be caused by movement of the riser 5 in the aperture 342 to allow workers to work on riser 5 while engaged with the floating platform 324.

FIG. 6G further illustrates the roller guide assembly 350 disposed in an aperture 352 of the floating platform 324. In some embodiments, the aperture 352 may be surrounded by a foot barrier (not illustrated). The foot barrier may be a guard or rail that extends vertically from the surface of the floating platform 324 about the aperture 352. Additionally, the roller guide assembly 350 may operate to engage the floating platform 324 with the riser 5 while still allowing for vertical movement of the riser with respect to the floating platform. Detailed versions of the roller guide assembly 350 are illustrated in conjunction with FIGS. 7A-7C.

Figure 7A:
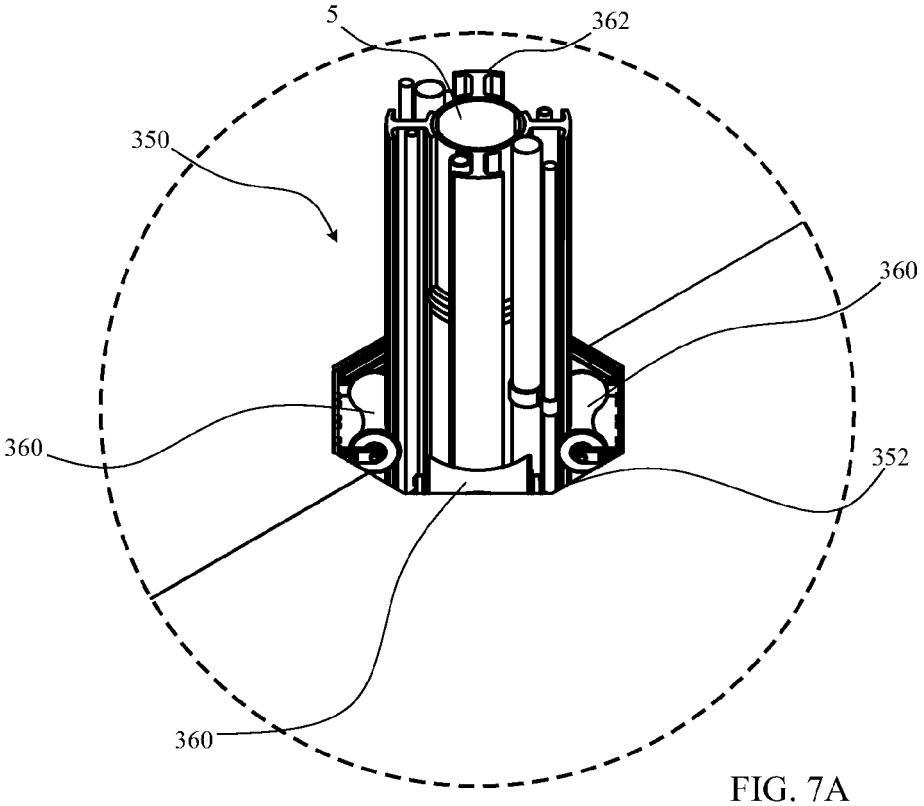
Figure 7B:
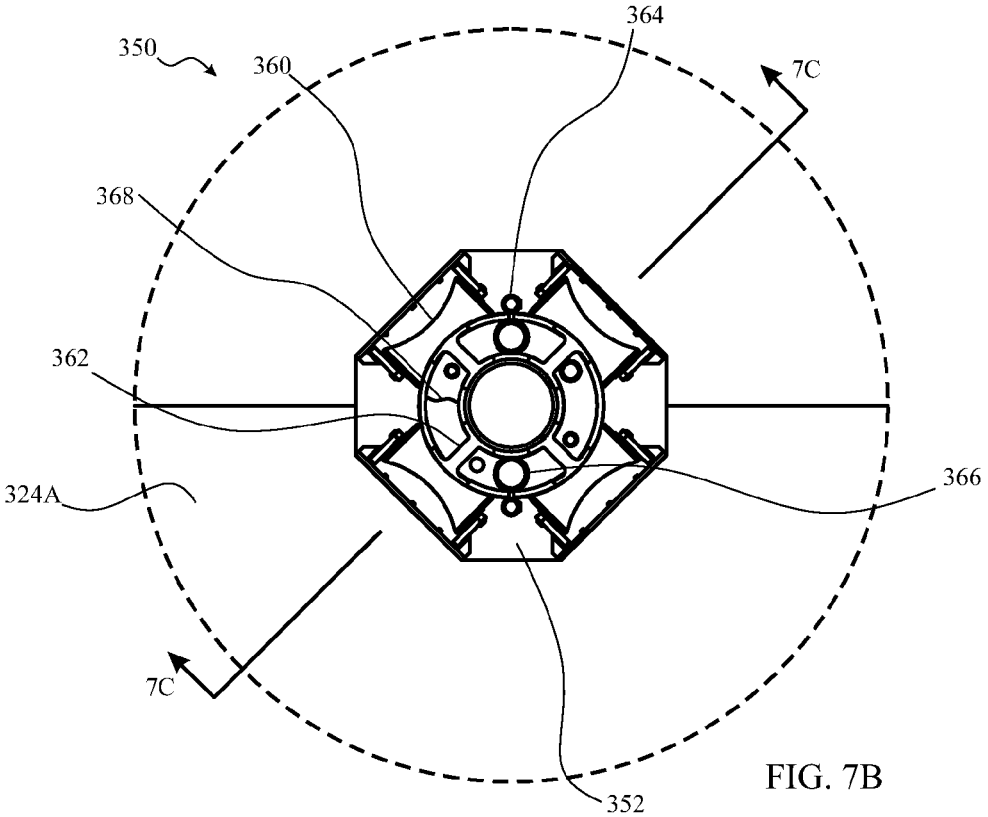

FIG. 7A illustrates an isometric view of the roller guide assembly 350. As illustrated, the roller guide assembly 350 may include one or more riser centralizing rollers 360 that interact with a respective riser fin 362 of the riser 5. In one embodiment, each of the riser centralizing rollers 360 allows for the riser 5 to move vertically and positions the riser 5 centrally in aperture 352. In one embodiment, each of the riser centralizing rollers 360 is moveably coupled to a respective riser fin 362 of the riser 5 such that each of the riser centralizing rollers 360 rolls when the riser 5 moves in a vertical direction. FIG. 7B illustrates a top view of the roller guide assembly 350 and further details the interaction of the riser centralizing rollers 360 with the riser fins 362.

As illustrated in FIG. 7B, the riser centralizing rollers 360 may be disposed about the aperture 352 and may each engage a respective riser fin 362. Also illustrated in FIG. 7B, one or more umbilical lines 364 (e.g., one or more chemical, hydraulic, and/or electrical conductors for power and control systems), one or more choke/kill lines 366 (e.g., conduits arranged along the riser 5 for circulation of fluids into and out of a well bore to control well pressure), and a riser slick joint 368. Additionally illustrated in FIG. 7B is a sectional cutout "A" of the riser 5 and the roller guide assembly 350, as further illustrated in FIG. 7C.

FIG. 7C illustrates the sectional cutout "A" of FIG. 7B. As illustrated, the riser centralizing rollers 360 may include a roller cushion assembly 370 that allows the riser centralizing rollers 360 to maintain a movable engagement with the riser fins 362 of the riser 5. For example, as a joint of the riser 5 passes the riser centralizing rollers 360, the roller cushion assembly 370 may allow the riser centralizing rollers 360 to move in a direction away from the riser 5 while still maintaining sufficient pressure on the riser 5 to maintain its horizontal positioning within the aperture 352.

FIGS. 8A-8C illustrate various versions of the riser 5. It should be noted that in some embodiments, riser 5 has no riser fins 362. As illustrated in FIG. 8A, riser 5 may include a main portion 372. The riser fins 362 may be disposed about the main portion 372. For example, the riser fins 362 may be disposed equidistant (approximately 90 degrees) from one another about the main portion 372. Additionally, as illustrated in the profile view of the riser 5, the riser fins 362 may extend a length 374 less than an entire length 376 of a riser 5. In one embodiment, the riser fins 362 may taper at the ends of the length 374 of the riser 5 such that the riser fins 362 terminate at a joint 378 of the riser 5. In this manner, the riser fins 362 may extend a constant distance 380 from the main portion 372 of the riser 5 so that there is a consistent surface at distance 380 around the main portion 372 of the riser 5.

FIG. 8B illustrates a second embodiment of the riser 5. In the illustrated embodiment, the riser 5 includes six riser fins 362. Each of the six riser fins 362 may be disposed about the main portion 372. For example, each riser fin 362 may be disposed equidistant (approximately 60 degrees) from one another about the main portion 372. By utilizing six riser fins 362, additional ease of stacking and storing the risers 5 may be accomplished.

FIG. 9 illustrates a second embodiment of the floating platform 324. In the illustrated embodiment, each portion 324A and 324B includes two cutouts that combine to form apertures 382. Apertures 382 may be similar to aperture 352 discussed above, however, by having two apertures 382, multiple risers 5 may pass through the floating platform 324. It should further be noted that while two apertures 382 are illustrated, more than two apertures are contemplated. Furthermore, it should be noted that each aperture 382 may allow a riser to pass through a single aperture 342 of the moveable platform 322 or through distinct apertures 342 that each correspond to a respective aperture 382.

Present techniques and systems allow for use of a floating platform and/or a floating platform in conjunction with a moveable platform that span a moon pool area of an offshore platform. Through the use of the floating platform, work on a riser that typically would be characterized as "work over the side" may be re-characterized as not constituting "work over the side." Accordingly, riser work, which might otherwise be delayed due to events (harsh weather conditions, etc.), may be performed. This allows for less downtime of the offshore platform and, therefore, increases the efficiency of the offshore platform.

This written description uses examples to disclose the above description, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Accordingly, while the above disclosed embodiments may be susceptible to various modifications and alternative forms, specific embodiments have been shown by way of example in the drawings and have been described in detail herein. However, it should be understood that the embodiments are not intended to be limited to the particular forms disclosed. Rather, the disclosed embodiment are to cover all modifications, equivalents, and alternatives falling within the spirit and scope of the embodiments as defined by the following appended claims.

What is claimed is:

1. A system, comprising:

a first moveable platform configured to be disposed in a fixed position in a moon pool area of an offshore platform; and a second moveable platform configured to be movably coupled to a first surface of the first moveable platform over the moon pool area, wherein the second movable platform is configured to move in at least two perpendicular directions across the first surface of the first moveable platform.

2. The system of claim 1, wherein the offshore platform comprises an offshore semi-submersible drilling rig or a drillship.

3. The system of claim 1, wherein the first movable platform comprises a first aperture sized to allow a riser to pass through the first aperture, wherein the second movable platform comprises a second aperture sized to allow the riser to pass through the second aperture.

4. The system of claim 3, wherein the second movable platform comprises at least one centralizing roller configured to be movably coupled to the riser.

5. The system of claim 4, wherein the centralizing roller is configured to be movably coupled to the riser via a riser fin of the riser.

6. The system of claim 5, comprising the riser, wherein the riser fin comprises a tapered portion coupled to a joint of the riser to form a continuous surface along a length of the riser.

7. The system of claim 5, comprising the riser, wherein the riser comprises a second riser fin, a third riser fin, and a fourth riser fin.

8. The system of claim 7, wherein each of the riser fin, the second riser fin, the third riser fin, and the fourth riser fin are disposed equidistant from one another about the riser.

9. The system of claim 1, comprising an enclosure housing each of the first moveable platform and the second movable platform.

10. The system of claim 9, wherein the enclosure is configured to be disposed beneath a bottom deck of the offshore platform.

11. The system of claim 9, wherein the enclosure comprises a retractable covering disposed along an edge of the moon pool area.

12. A method, comprising:

moving a first portion of a moveable platform from a first position in an offshore platform to a second position over a moon pool area of the offshore platform;

moving a first portion of a second moveable platform from the first position to a third position over the moon pool area;

moving a second portion of the moveable platform from a fourth position in the offshore platform to a fifth position over the moon pool area to form a first surface spanning the first portion of the moveable platform and the second portion of the moveable platform; and moving a second portion of the second moveable platform from the fourth position to a sixth position over the moon pool area to form a second surface spanning the first portion of the second moveable platform and the second portion of the second moveable platform, wherein the second surface is configured to move in at least two perpendicular directions across the first surface.

13. The method of claim 12, comprising coupling the first portion of the moveable platform in the second position to the second portion of the moveable platform in the fifth position.

14. The method of claim 12, comprising coupling the first portion of the second moveable platform in the third position to the second portion of the second moveable platform in the sixth position.

15. The method of claim 14, comprising coupling the first portion of the second moveable platform to the second portion of the second moveable platform via a locking device.

16. The method of claim 12, comprising coupling the first portion of the second moveable platform in the third position and the second portion of the second moveable platform in the sixth position to a riser of the offshore platform.

17. A system, comprising:

a control panel configured to:

provide a first signal to cause a first portion of a moveable platform to be moved over a moon pool area of an offshore platform and to cause a second portion of the moveable platform to be moved over the moon pool area to form a first surface spanning the first portion of the moveable platform and the second portion of the moveable platform; and provide a second signal to cause a first portion of a second moveable platform to be moved over the moon pool area and to cause a second portion of a second moveable platform to be moved over the moon pool area to form a second surface spanning the first portion of the second moveable platform and the second portion of the second moveable platform, wherein the second surface is configured to move in at least two perpendicular directions across the first surface.

18. The system of claim 17, wherein the control panel is configured to provide the first signal to provide concurrent movement of the first portion of the moveable platform and the second portion of the moveable platform.

19. The system of claim 18, wherein the control panel is configured to provide the second signal to provide concurrent movement of the first portion of the second moveable platform and the second portion of the second moveable platform subsequent to the concurrent movement of the first portion of the moveable platform and the second portion of the moveable platform.

* * * * *